US006929133B1

(12) United States Patent
Knapp, III et al.

(10) Patent No.: US 6,929,133 B1
(45) Date of Patent: Aug. 16, 2005

(54) DISPLAY SYSTEM AND METHODS

(75) Inventors: Edward R. Knapp, III, Norwalk, CT (US); Arthur R. Martin, Westport, CT (US); Christopher S. Anderson, Stamford, CT (US); Richard J. Fellinger, Franklin Lakes, NJ (US)

(73) Assignee: Mechtronics Corporation, White Plains, NY (US)

( * ) Notice: Subject to any disclaimer, the term of this patent is extended or adjusted under 35 U.S.C. 154(b) by 371 days.

(21) Appl. No.: 09/757,842

(22) Filed: Jan. 10, 2001

Related U.S. Application Data

(60) Provisional application No. 60/175,327, filed on Jan. 10, 2000, provisional application No. 60/211,705, filed on Jun. 15, 2000.

(51) Int. Cl.[7] ..... A47F 5/08

(52) U.S. Cl. ..... 211/118; 211/132.1; 211/149; 211/135

(58) Field of Search ..... 211/118, 73, 132.1, 211/131.1, 133.1, 187, 50, 72, 70.1, 135, 211/189, 149; 248/174, 459; 206/741

(56) References Cited

U.S. PATENT DOCUMENTS

| | | | | | |
|---|---|---|---|---|---|
| 955,734 | A | * | 4/1910 | Wolkerstofer | 211/134 |
| 1,725,524 | A | | 10/1929 | Knodolf | |
| 1,732,436 | A | | 10/1929 | Floto | |
| 1,902,262 | A | | 3/1933 | Powell | |
| 2,132,526 | A | | 10/1938 | Buser | |
| 2,259,041 | A | | 10/1941 | Larkin | |
| 2,730,232 | A | | 1/1956 | Coe | |
| 2,926,834 | A | | 3/1960 | Kaslow | |
| 3,027,064 | A | | 3/1962 | Thomas | |
| 3,390,810 | A | | 7/1968 | Schneeweiss | |
| 3,567,014 | A | | 3/1971 | Feigleman | |
| 3,999,662 | A | * | 12/1976 | Barnhardt | 211/126.16 |
| 4,166,332 | A | * | 9/1979 | Donovan | 40/605 |
| D254,821 | S | * | 4/1980 | Rabas | D6/468 |
| 4,201,291 | A | * | 5/1980 | Davidson | 206/768 |
| 4,213,559 | A | | 7/1980 | Meyers | |
| 4,215,840 | A | * | 8/1980 | Babberl | 248/214 |
| 4,228,904 | A | * | 10/1980 | Dumond | 211/55 |
| 4,311,233 | A | | 1/1982 | Austin | |
| 4,396,115 | A | | 8/1983 | Watson | |
| 4,483,502 | A | * | 11/1984 | Fast | 248/223.41 |
| 4,537,316 | A | * | 8/1985 | Simon et al. | 211/133.3 |
| 4,573,590 | A | * | 3/1986 | Ellis | 211/118 |
| 4,592,464 | A | | 6/1986 | Londagin | |
| 4,606,467 | A | * | 8/1986 | Everett | 211/60.1 |
| 4,673,090 | A | * | 6/1987 | Crosslen | 211/183 |
| 4,687,094 | A | * | 8/1987 | Allsop et al. | 206/774 |
| 4,708,311 | A | | 11/1987 | Clausen et al. | |
| 4,733,782 | A | * | 3/1988 | Spezial et al. | 211/57.1 |
| 4,753,341 | A | * | 6/1988 | McIntyre | 211/130.1 |
| 4,760,928 | A | * | 8/1988 | Bustos | 211/59.4 |
| 4,938,368 | A | * | 7/1990 | Sharman | 211/57.1 |

(Continued)

*Primary Examiner*—Leslie A. Braun
*Assistant Examiner*—Khoa Tran
(74) *Attorney, Agent, or Firm*—Wiggin and Dana LLP

(57) ABSTRACT

A retail display system and related methods. A plastic strut is unitarily-formed with and depends from a header. The strut has a vertical array of engagement features. A plurality of product-holding elements are each engaged to an associated feature of the engagement features to secure the elements to the strut.

7 Claims, 23 Drawing Sheets

U.S. PATENT DOCUMENTS 5,086,935 A 2/1992 Gallagher
5,213,254 A 5/1993 Regis et al.
5,253,769 A * 10/1993 Vlastakis ..... 211/126.16
5,284,259 A 2/1994 Conway et al.
5,294,194 A * 3/1994 Lombardo ..... 312/229
5,305,898 A 4/1994 Merl
5,346,166 A * 9/1994 Valiulis ..... 211/57.1
5,386,916 A * 2/1995 Valiulis ..... 211/113
5,415,301 A * 5/1995 Bruton et al. ..... 211/183
5,513,745 A * 5/1996 Zoltan et al. ..... 206/741
5,529,192 A * 6/1996 Conen et al. ..... 211/189
5,542,551 A * 8/1996 Smith ..... 211/50
5,566,844 A * 10/1996 Bernardin ..... 211/189
5,626,926 A * 5/1997 Roberts ..... 428/14
5,758,783 A * 6/1998 Maglione ..... 211/126.16
5,794,782 A * 8/1998 Ascik ..... 206/600
5,836,455 A * 11/1998 Connor et al. ..... 206/757
5,875,901 A 3/1999 Morrow et al.
5,890,607 A * 4/1999 Maglione ..... 211/189
5,938,048 A * 8/1999 Carroll et al. ..... 211/55
5,957,422 A 9/1999 Shea
5,975,415 A 11/1999 Zehnal
5,984,120 A * 11/1999 Johnske ..... 211/126.16
6,006,929 A * 12/1999 Leonard ..... 211/106
6,068,140 A * 5/2000 Mangrum et al. ..... 206/741
6,116,433 A * 9/2000 Pursall ..... 211/55
6,116,498 A 9/2000 Sheffer
6,135,030 A * 10/2000 Besaw ..... 108/51.3
6,193,085 B1 * 2/2001 Nook et al. ..... 211/187
6,206,493 B1 * 3/2001 Sanchez-Levin et al. ... 312/125
6,378,710 B1 * 4/2002 Grueneberg ..... 211/132.1
6,488,245 B1 * 12/2002 Maglione ..... 248/174

* cited by examiner

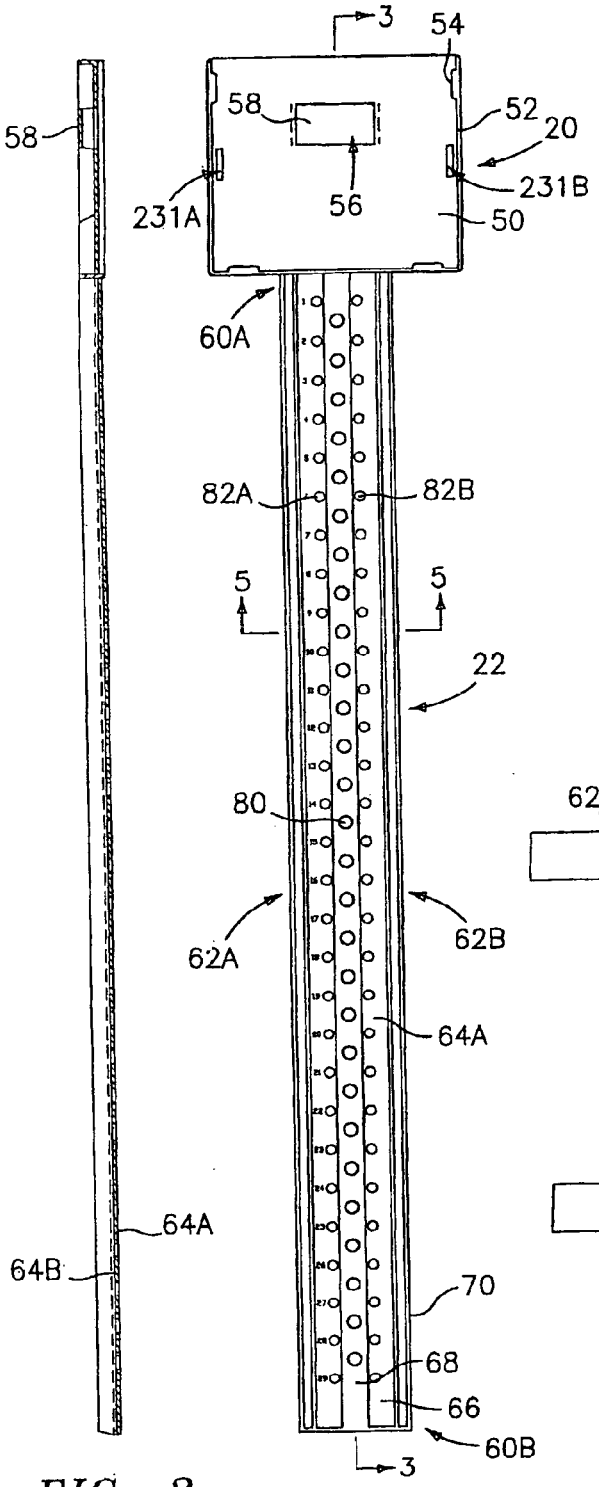
FIG. 3
FIG. 2
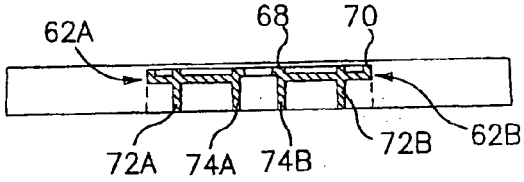
FIG. 5
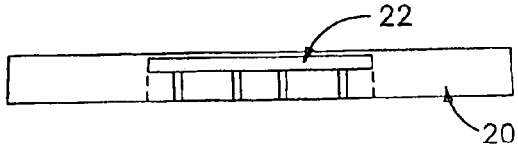
FIG. 4

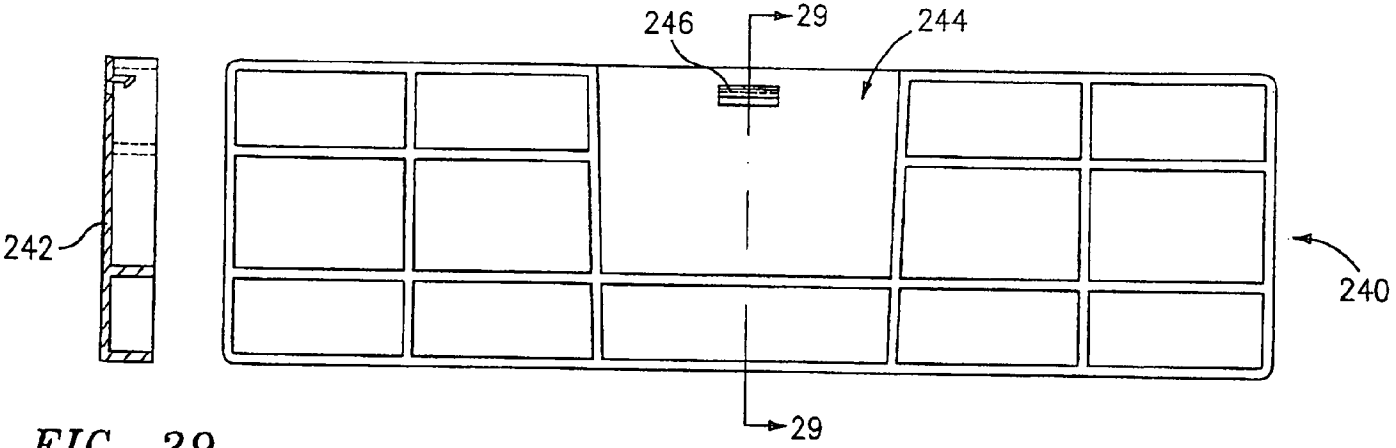
FIG. 28
FIG. 29
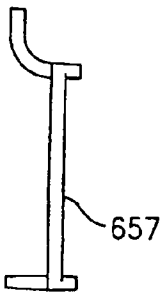
FIG. 51
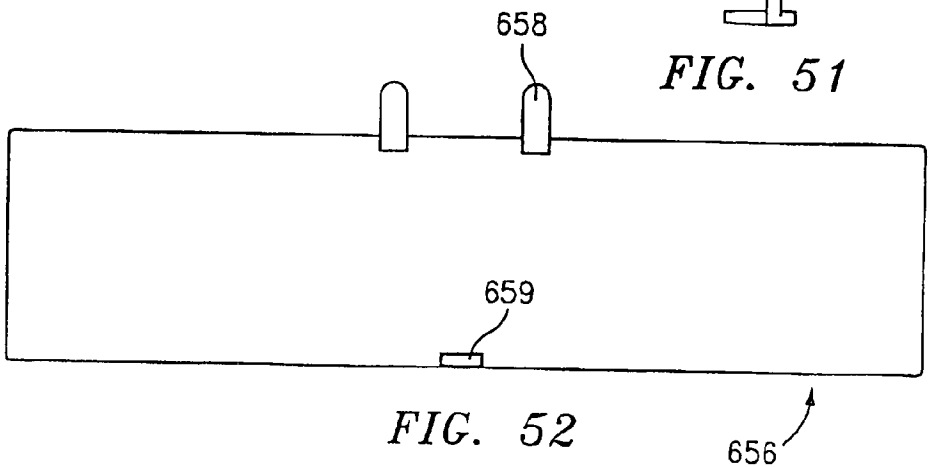
FIG. 52
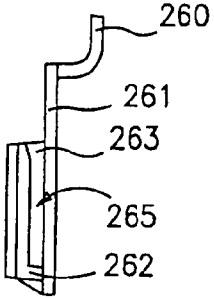
FIG. 32
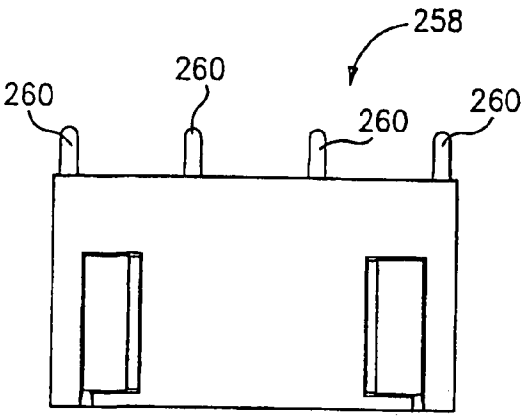
FIG. 31

DISPLAY SYSTEM AND METHODS

CROSS-REFERENCE TO RELATED APPLICATIONS

This patent application claims priority of U.S. Provisional Patent Applications Ser. No. 60/175,327 entitled "Display System" that was filed on Jan. 10, 2000, and Ser. No. 60/211,705 entitled "Display System" that was filed on Jun. 15, 2000, the disclosures of which are incorporated by reference in their entireties herein.

BACKGROUND OF THE INVENTION

1. Field of the Invention

This invention relates to product displays, and more particularly to retail displays for small product packages.

2. Description of the Related Art

A wide variety of systems exist for displaying goods in the retail environment. Many such systems are used to display many small product packages. These various systems make use of many product holding means including hooks, trays, chutes, and the like. Some displays are freestanding while others are mounted to a support structure such as a shelving gondola. Common gondola configurations feature long rows of shelving facing aisles on either side of the gondola. At the gondola's ends, additional shelving or other display areas define end caps. One common auxiliary display system is known as the power wing, typically secured at the side of an end cap and protruding slightly into the adjacent aisle. Smaller displays may be secured to the sides of the power wing and may face the longitudinal direction of the aisle. Such smaller displays are often identified as mini wings. Mini wing-type displays may also be mounted to shelving fronts to protrude into an aisle. These may include portions facing the aisle or facing the longitudinal direction of the aisle.

A number of such displays have been proposed in a vertical strip-like form wherein hooks or other holders can be secured at various locations along the length of the strip. Examples of these are found in U.S. Pat. Nos. 5,305,898, 5,875,901, and 5,957,422. There, however, remain a variety of areas for improvement in the art.

BRIEF SUMMARY OF THE INVENTION

Accordingly, in one aspect, the invention is directed to a retail display system and related methods. A plastic strut is unitarily-formed with and depends from a header. The strut has a vertical array of engagement features. A plurality of product-holding elements are each engaged to an associated feature of the engagement features to secure the elements to the strut.

Key product-holding elements are trays formed of folded corrugated material for containing the product. Preferably, the trays have side, front, and rear walls arranged in a rectangle and an orthogonal bottom wall. Advantageously, the bottom wall is held with a front-to-back declination (e.g., about 5°–25°). The declination may be provided by a foldable deployable portion on the back wall of the tray which tilts the tray relative to a vertical mounting surface such as the strut. Alternatively, a molded plastic support fixture may have a declined support surface for engaging the bottom of the tray. Alternatively, the strut may be held by a folded corrugated base at an angle off vertical to provide the declination.

In other aspects, the invention is directed to the engagement feature configuration of the strut and to features of the tray-supporting fixtures which engage the strut.

In other aspects, the invention is directed to other fixtures for engaging the strut and mounting the strut to gondola shelving, supporting the strut atop a floor, and the like.

In other aspects, the invention is directed to tray configurations, including configurations for engaging the fixtures, configurations which have a self-tilting feature, and configurations which have a deployable portion for forwardly offsetting a lower portion of the tray back wall.

In other aspects, the invention is directed to methods relating to manufacture and use of a retail display system.

In other aspects, the invention is directed to a dispenser featuring a vacuum-formed element serving as the core of a chute assembly. The dispenser may hold one or more stacks of products along flow paths at least partially defined by convolutions in the core.

In other aspects, the invention is directed to the display chassis including a generally rectangular central portion of folded box construction. A plastic frame includes at least left and right members proximate left and right sides of the central portion. A plurality of shelf assemblies have pairs of left and right engagement features for moveable securement to left and right engagement features of the chassis.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

FIG. 2 is a front view of a header and spine of the kit of FIG. 1.

FIG. 3 is a longitudinal cross-sectional view of the header and spine of FIG. 2, taken along line 3—3.

FIG. 4 is a bottom view of the header and spine of FIG. 2.

FIG. 5 is a bottom cross-sectional view of the header and spine of FIG. 2, taken along line 5—5.

FIG. 28 is a bottom view of a tray carrying fixture adapter.

FIG. 29 is a side cross-sectional view of the adapter of FIG. 28, taken along line 29—29.

FIGS. 31 and 32 are front and right side views of a hook adapter for mounting a tray-carrying fixture directly to a pegboard wall.

FIGS. 51 and 52 and side and back views of a cross member of the display of FIG. 50.

Like reference numbers and designations in the various drawings indicate like elements.

DETAILED DESCRIPTION

Figure 1:
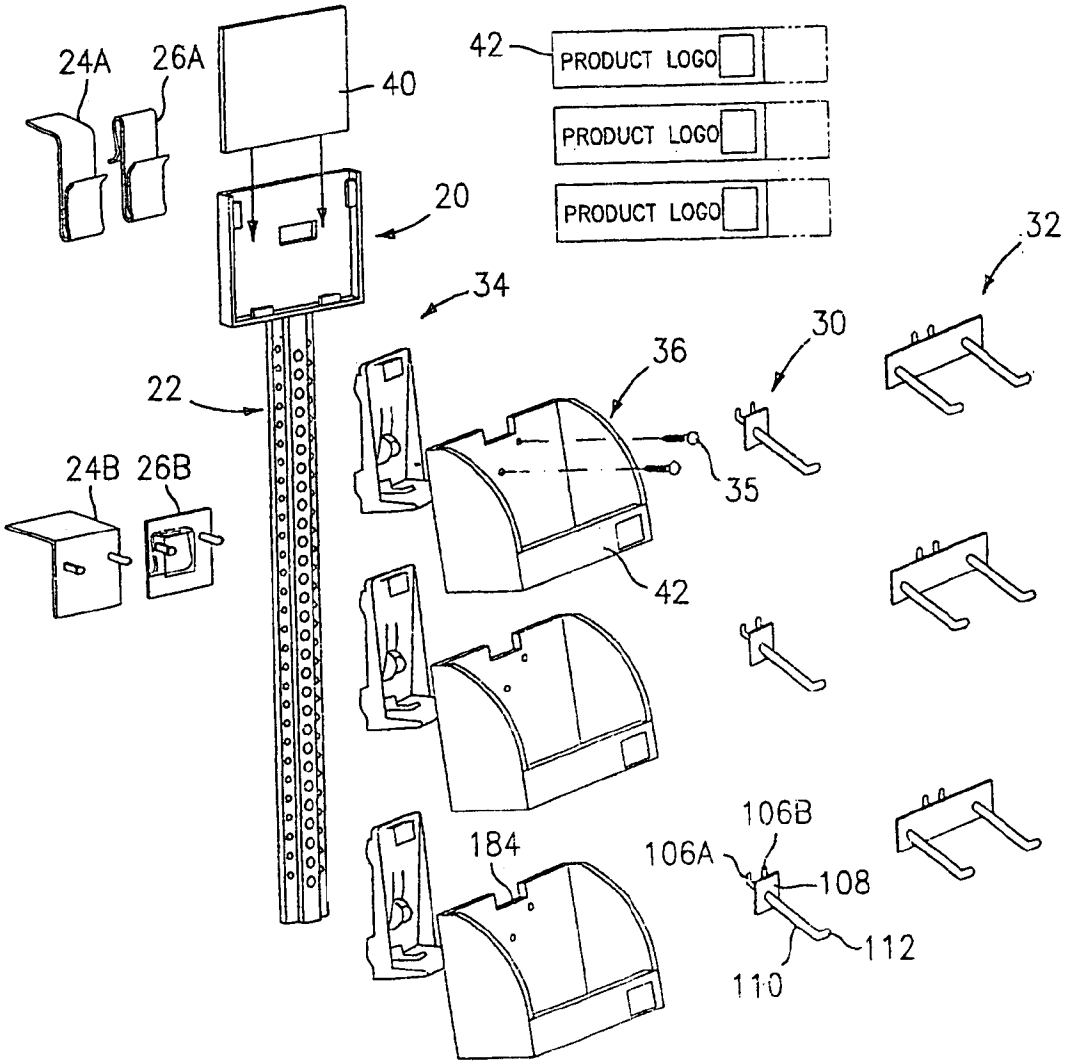
FIG. 1 is a view of component parts in a kit for forming a retail display.

By way of overview, FIG. 1 shows an exemplary group of component parts for assembling a retail display. A primary element comprises the combination of a header 20 and a spine or strut 22 depending from the header. The spine and header are preferably unitarily-formed as a single plastic piece (e.g., of medium impact polystyrene (MIPS) or of acrylonitrile butadiene styrene (ABS)) such as by injection molding. A first pair of upper and lower mounting elements such as brackets 24A, 24B are provided attachable to the combined header and spine to secure the header and spine to an environmental structure (e.g., shelving). An alternate pair of upper and lower mounting elements 26A, 26B is provided to similarly secure the header and spine to alternate environmental structures such as a wire rack. Various combinations of product-holding elements may be secured along the length of the spine 22. Such product-holding elements may include single shaft hooks 30, multi-shaft hooks 32, and fixtures 34 for carrying product-containing trays 36. Alternatively, the trays may be secured directly to the spine via a pair of Christmas tree clips 35. Exemplary products to be contained within the trays 36 are cosmetic and toiletry bottles, tubes, and other containers (not shown). A graphic panel 40 may be provided to be carried by the header and tray labels 42 may be provided for the trays 36.

The exemplary header 20 (FIG. 2) is generally rectangular in plan, having a flat web or body 50. A rim or flange 52 circumscribes all four edges of the body 50 to define top, bottom, left, and right sides of the header (such directions determined from the point of view of a user facing an assembled display in use). On all four sides, the flange 52 extends rearward beyond the adjacent back surface of the body. On the bottom, left and right sides, the flange extends forward of the adjacent front surface of the body. Projecting inward from the flange in front of the body 50 along the left, right and bottom sides of the header are retainer projections 54, the back surfaces of which are parallel to and opposite the front surface of the body 50. These projections, along with the absence of a forward-projecting portion of the flange 52 along the body upper edge, allow insertion of the graphic panel 40 (FIG. 1) downward to an installed position with its back surface flat against the front surface of the body 50 and the back surfaces of projections 54 engaging the panel front surface to retain the panel within the header. An aperture 56 formed within the body 50 is rearwardly bridged or overarched by a strip portion 58, joining the body 50 at left and right sides of the aperture 56. The strip 58 provides a feature for engaging the upper mounting element (e.g., 24A; 26A) (as discussed in further detail below).

Depending from the flange 52 at the bottom side of the header, the spine 22 extends from an upper end 60A to a lower end 60B and has left and right sides 62A and 62B and front and rear surfaces 64A and 64B (FIG. 3). The spine includes a web or body 66 having a central vertically-extending, forwardly raised, portion 68. The body 66 is circumscribed along its left, right, and bottom edges by a flange 70, extending forward to be substantially coplanar with the front surface of the central portion 68. At its upper edge, the spine body 66 joins the header flange 52, the nonraised portions of the spine body 66 being substantially coplanar with the header body 50. Along its back surface, the body 66 bears a pair of left and right outboard vertically-extending structural reinforcement ribs 72A and 72B, slightly recessed from the respective left and right spine sides 62A and 62B and extending as far rearward as does the header flange 52. Similar left and right inboard ribs 74A and 74B are positioned behind left and right extremities of the central portion 68.

The spine 22, along the body central portion 68, bears a central vertical array of engagement features 80 formed as front-to-back circular holes spaced at a given pitch (e.g., 2.5 cm). On either side of the central portion 68, the spine body 66 bears vertical arrays of left and right holes 82A and 82B at a pitch which may be the same as or otherwise related to the pitch of the holes 80. The exemplary holes 82A and 82B are smaller in diameter than the holes 80.

Figure 6:
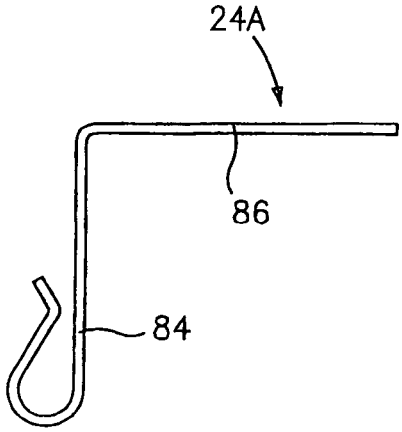
FIGS. 6 and 7 are right side and front views of the upper mounting bracket of the kit of FIG. 1.
Figure 7:
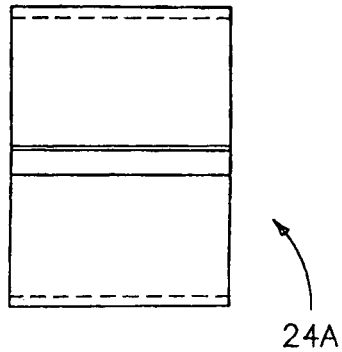
Figure 8:
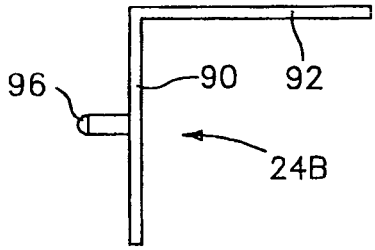
FIGS. 8 and 9 are right side and bottom views of a lower mounting bracket of the kit of FIG. 1.
Figure 9:
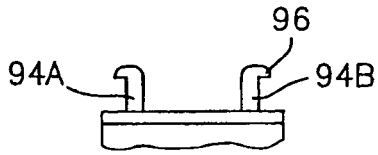

The upper bracket 24A (FIG. 6) may be an extruded plastic such as MIPS or ABS. In section, the bracket includes a generally J-shaped portion 84 and a top plate portion 86 extending rearward from the head of the J. The underside of the top portion 86 may be placed atop and adhered to an upper surface of an upper shelf (not shown) in a shelving system (e.g., via double-sided adhesive tape). The header and spine may then be hung on the portion 84 via lowering the strip 58 (FIG. 3) into the hook of the J-shaped portion 84 to suspend the header and spine from the bracket 24A. The lower bracket 24B (FIG. 8) may be provided for additional support and/or stability. The lower bracket 24B may be unitarily formed of injection molded plastic (e.g., MIPS or ABS) having a vertical body plate 90 and a top plate 92 extending rearward from the top thereof. Extending forward from the front surface of the plate 90 are a pair of left and right barbed prongs 94A and 94B (FIG. 9) having dimensions and separation effective to permit them to be inserted from behind the spine into an associated pair of the holes 82A and 82B. When so inserted, the prong barbs 96 catch on the front surface of the spine body 66 to prevent removal of the bracket 24B except when a sufficient inward force is applied to the barbs to release them. When the bracket 24B is so secured to the spine, the header may then be hung from the upper bracket 24A with the underside of the top plate 92 engaging the upper surface of a lower shelf (not shown). Alternatively, the upper surface of the plate 92 may engage the underside of the lower shelf. Alternatively, the header may first be hung from the upper bracket and then the lower bracket positioned with the most appropriate set of mounting holes.

Figure 10:
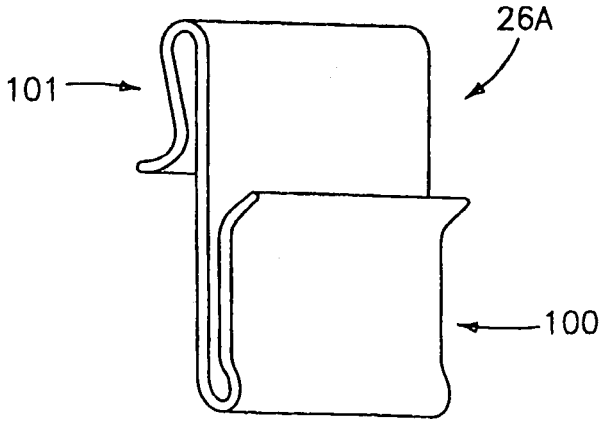
FIG. 10 is a view of an alternate upper mounting element of the kit of FIG. 1.
Figure 11:
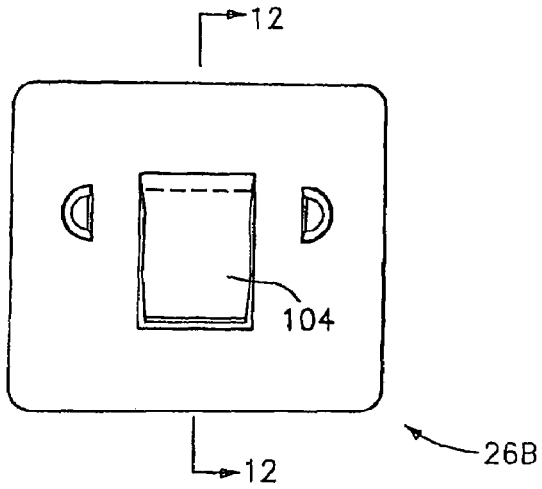
FIG. 11 is a rear view of an alternate lower mounting element of the kit of FIG. 1.
Figure 12:
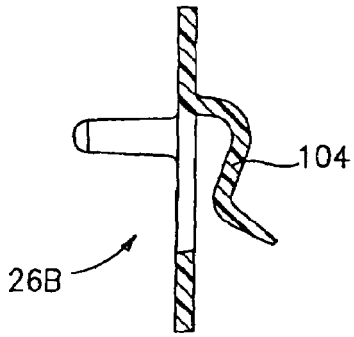
FIG. 12 is a side cross-sectional view of the element of FIG. 11, taken along line 12—12.
Figure 13:
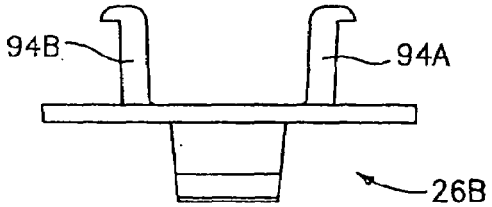
FIG. 13 is a top view of the element of FIG. 11.

The alternate upper mounting element 26A (FIG. 10) may have a cross-section similar to a transversely flattened letter S. Examples of such elements are available from Fasteners For Retail, Inc. (FFR) 225 Alpha Park, Cleveland, Ohio as part 8307603700, formed of extruded polyvinyl chloride (PVC). The element 26A includes an upwardly open lower front hook portion 100 and a downwardly open upper rear hook portion 101. The portion 101 may be hung over a transverse wire in a wire rack and the header and spine suspended from the portion 100 via the header strip 58 as in the case of the support bracket 24A. The alternate lower mounting element 26B (FIGS. 11–13) includes the same barbed projections 94A, 94B as does the mounting bracket 26B but includes a downwardly open self-biasing spring clip portion 104 in place of the top plate 92. When the bracket 26B is secured to the spine, the clip 104 may be engaged to a transverse lower wire element of the wire rack at the same time as the header strip 58 is introduced to the portion 100 of the upper mounting element 26A.

Figure 15:
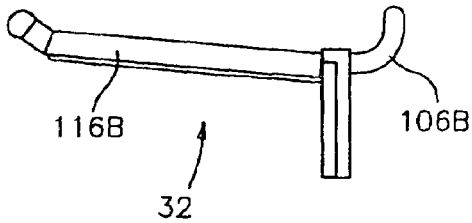
FIG. 15 is a right side view of the hook molding of FIG. 14.
Figure 14:
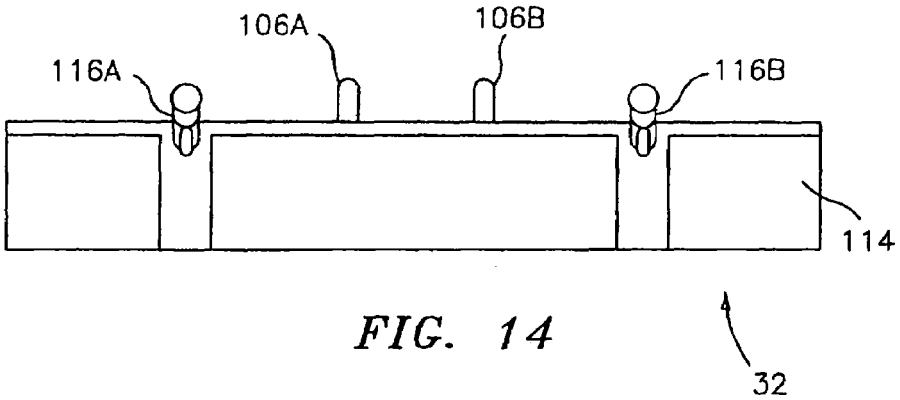
FIG. 14 is a bottom view of a two-shaft hook molding of the kit of FIG. 1.
Figure 16:
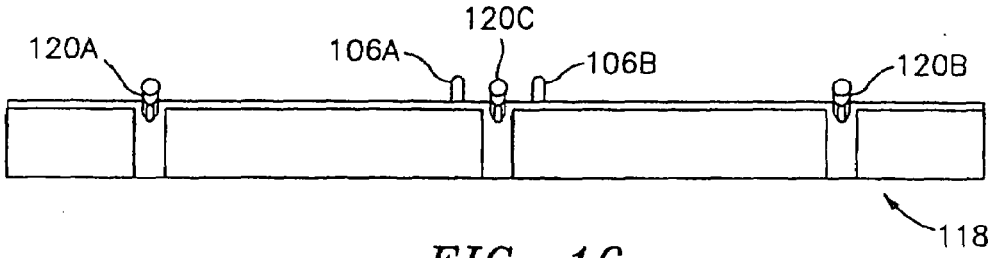
FIG. 16 is a bottom view of a three-shaft hook molding.

Returning to FIG. 1, each single shaft hook 30 includes a pair of upwardly-curving prong-like mounting projections 106A and 106B extending from the back surface of a body plate 108. A hook shaft 110 extends forward from a proximal root at the body plate 108 to a distal tip 112. In the exemplary embodiment, the distal tips are upwardly canted. The multi-shaft hooks 32 (by way of example two-shaft hooks of FIGS. 14 and 15) may be similarly formed to the hooks 30 such as by unitary plastic injection molding. The hook 32 may include the same mounting projections 106A and 106B as does the hook 30 but advantageously includes a relatively wide base plate 114. Left and right shafts 116A and 116B may be similarly formed to shaft 110 but, rather than centrally located, located on either side of the hook 32 with a pitch and a separation (pitch minus shaft diameter) effective to allow one group of product (not shown) to be suspended from the shaft 116A while another is suspended from the shaft 116B. An exemplary pitch is approximately 3.375 in., however a wide range of pitches/separation may be utilized. FIG. 16 shows a three-shaft hook 118 featuring left, right and central shafts 120A, 120B, 120C. These shafts are at an exemplary pitch of 4.25 in. For reasons of structural integrity, the shafts in the various molded hooks are advantageously relatively short (e.g., about 4–7 cm). An exemplary shaft diameter is 0.188 in., with a small reinforcement rib along its bottom. An exemplary shaft diameter range is about 4–5 mm. An exemplary pitch, in multi-shaft embodiments, is about 4–20 cm.

Figure 19:
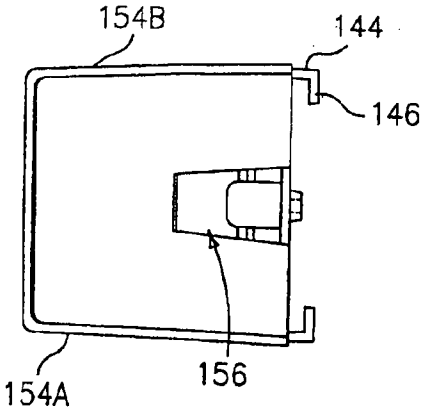
FIGS. 17, 18, 19 and 20 are right side, rear, bottom, and top views of a tray-carrying fixture of the kit of FIG. 1.
Figure 21:
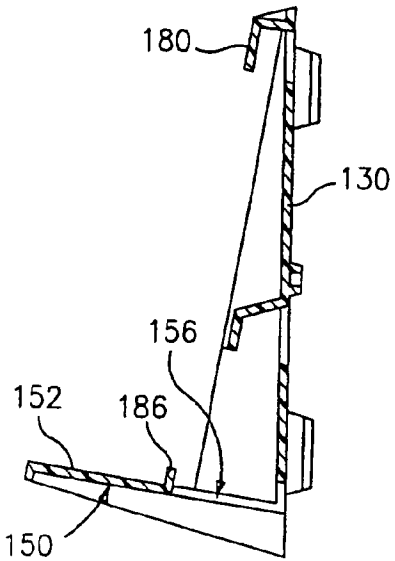
FIG. 21 is a side cross-sectional view of the fixture of FIG. 20, taken along line 21—21.
Figure 20:
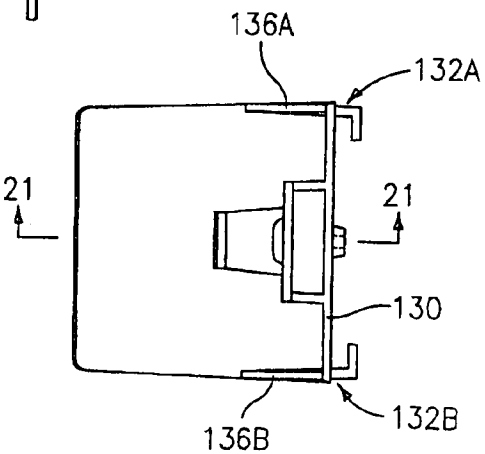
Figure 18:
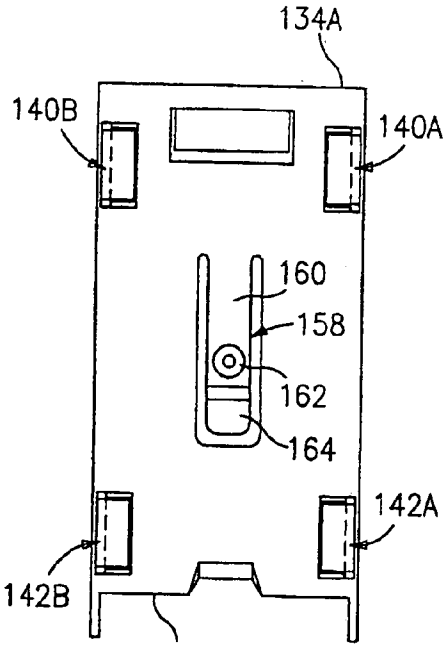
Figure 17:
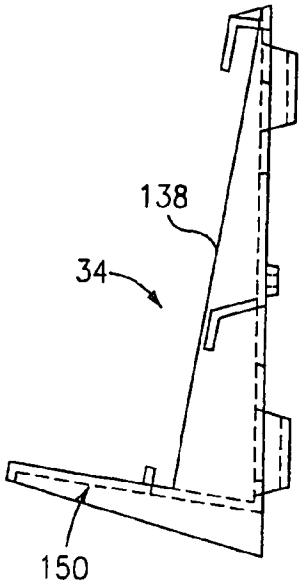

FIGS. 17–21 show further details of the fixture 34. The fixture is advantageously formed as a unitary plastic injection molding (e.g., of MIPS or ABS). The fixture includes a back or rear wall 130, generally rectangular in overall shape and vertically oriented in use. The wall 130 has left and right edges or sides 132A and 132B, a top 134A, and a bottom 134B. Left and right generally triangular side wall portion 136A and 136B extend forward from the left and right edges of the back wall 130. Each side wall portion 136A, 136B has an inclined forward edge 138 at an exemplary ten degree angle from the back wall. Left and right pairs of upper and lower L-sectioned fingers 140A, 140B, 142A, 142B extend rearward from the back wall 130, each having a rearwardly-extending proximal portion 144 and a transversely inward-projecting distal portion 146 (FIG. 19). A base portion 150 includes a platform portion 152 extending forward from the bottom edge of the back wall 130 and left and right side wall portions 154A and 154B depending from opposite sides of the platform 152 and extending forward from the generally triangular side wall portions 136A and 136B. The respective left and right side wall portions 136A and 136B and 154A and 154B combine to form respective left and right side walls of the fixture. The platform 152 has a central aperture 156 extending forward from its rear edge (FIG. 19). The back wall has a central aperture 158. An elongate latch 160 depends from an upper end of the aperture 158. An upper proximal portion of the latch 160 is coplanar with the back wall 130. At a lower distal end of the latch 160, the latch is molded with a rearward-directed projection 162. A lower distal portion 164 of the latch is spaced forward of the proximal portion in a relaxed state by a distance effective to allow the insertion of a user's index finger behind such distal portion 164, permitting the user's finger to flex the latch forward to bring the projection 162 forward of a plane defined by the rear surface of the back wall 130. This may be done from in front or through the aperture 156 (particularly if a tray is already on the fixture).

To assemble the fixture 34 to the spine 22, the fixture is slid over the spine from the spine lower end, the left and right upper fingers 140A and 140B extending around the left and right sides of the spine to engage the spine back. As the fixture is slid up the spine, the projection 162 will contact the spine bottom. The user then flexes the latch 160 to the flexed position, as previously noted, permitting the user to slide the fixture to a desired position along the spine, the left and right lower fingers 142A and 142B then extending around the spine left and right sides as do the associated upper fingers. With the fixture at the desired position, the latch is released allowing the projection 162 to enter an associated hole 80. If the projection 162 encounters an area between holes 80, the fixture is slid up or down until the appropriate hole is engaged by the projection 162. To vertically move the fixture, the user first flexes the latch and then moves the fixture to a desired position or removes it totally.

With the fixture in position on the spine, the user may secure a tray 36 to the fixture. An exemplary tray 36 is formed of die cut corrugated cardboard, folded to provide an open-top shipping and display tray having a bottom wall, left and right side walls, a rear wall, and a front wall. The front wall advantageously has a height substantially less than the heights of the left and right side walls and the rear wall. Each side wall may have an exposed upper edge which continuously convexly curves from the upper edge of the rear wall to the upper edge of the front wall. The tray 36 is placed in a partially reclined orientation and inserted so that its rear wall upper edge passes behind a projection 180 (FIG. 21) depending from the upper edge 134A of the fixture back wall 130. The projection 180 is formed as a finger having a proximal portion extending outward from the back wall and a distal portion more transverse to the back wall and advantageously approximately parallel to the side wall front edges 138. The folding process for the tray preferably provides the rear wall with double thickness. A cutout 184 (FIG. 1) may be provided to allow receipt of the proximal portion of the projection 180 and permit the distal portion to extend over the back wall below the cutout. The tray is raised approximately as far as it can go and then lowered slightly so that a projection 186 (extending transverse to the platform portion 152 of the base portion 150 at a front end of the aperture 156) is received by a corresponding hole (not shown) originally die cut in the bottom wall of the tray. In this lowered condition, cooperation of the projection 186 with the tray bottom wall and of the projection 180 with the tray back wall serve to retain the tray on the fixture.

Figure 22:
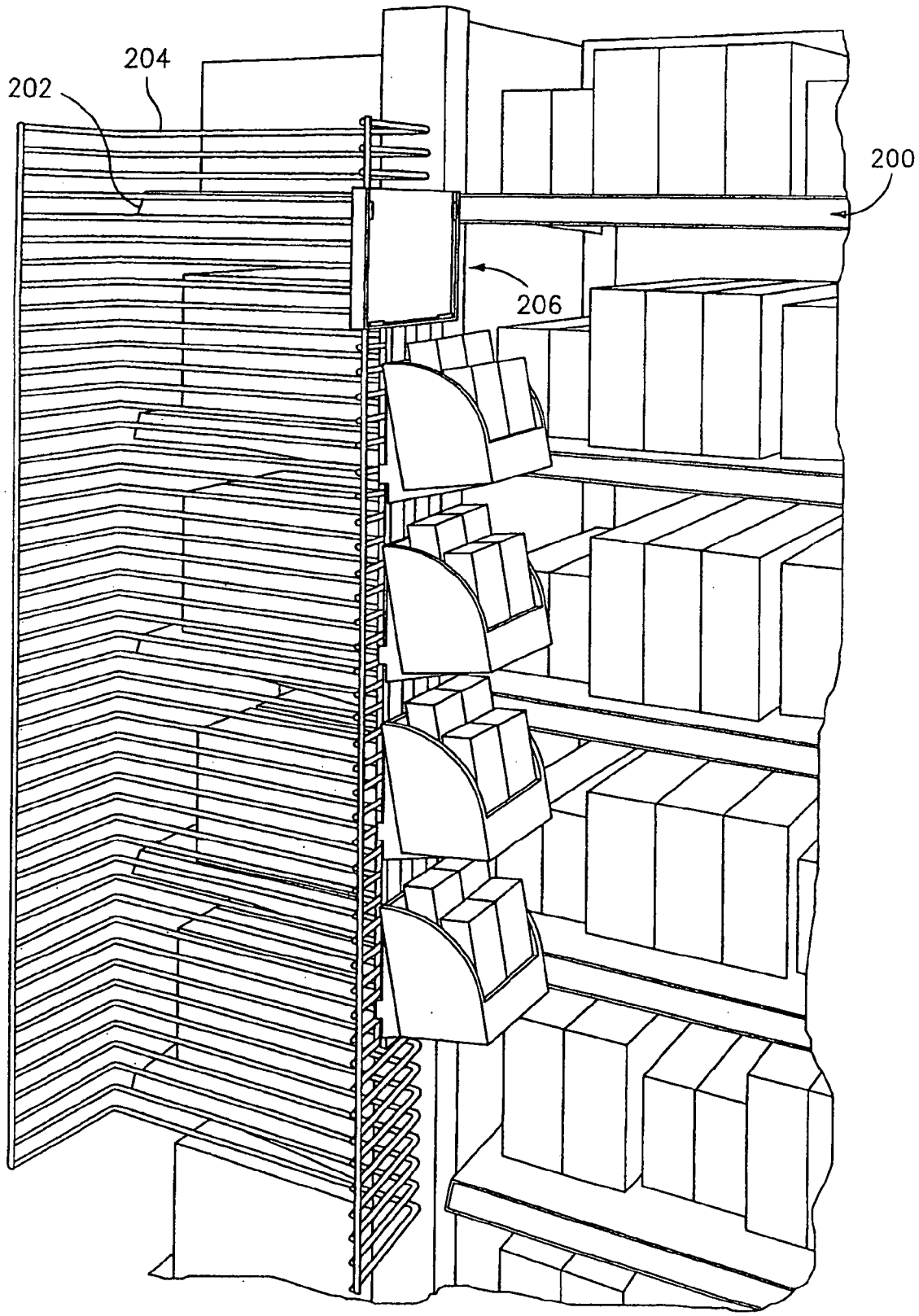
FIG. 22 is a view of an assembled display supported by a wire rack in a mini-wing configuration.
Figure 23:
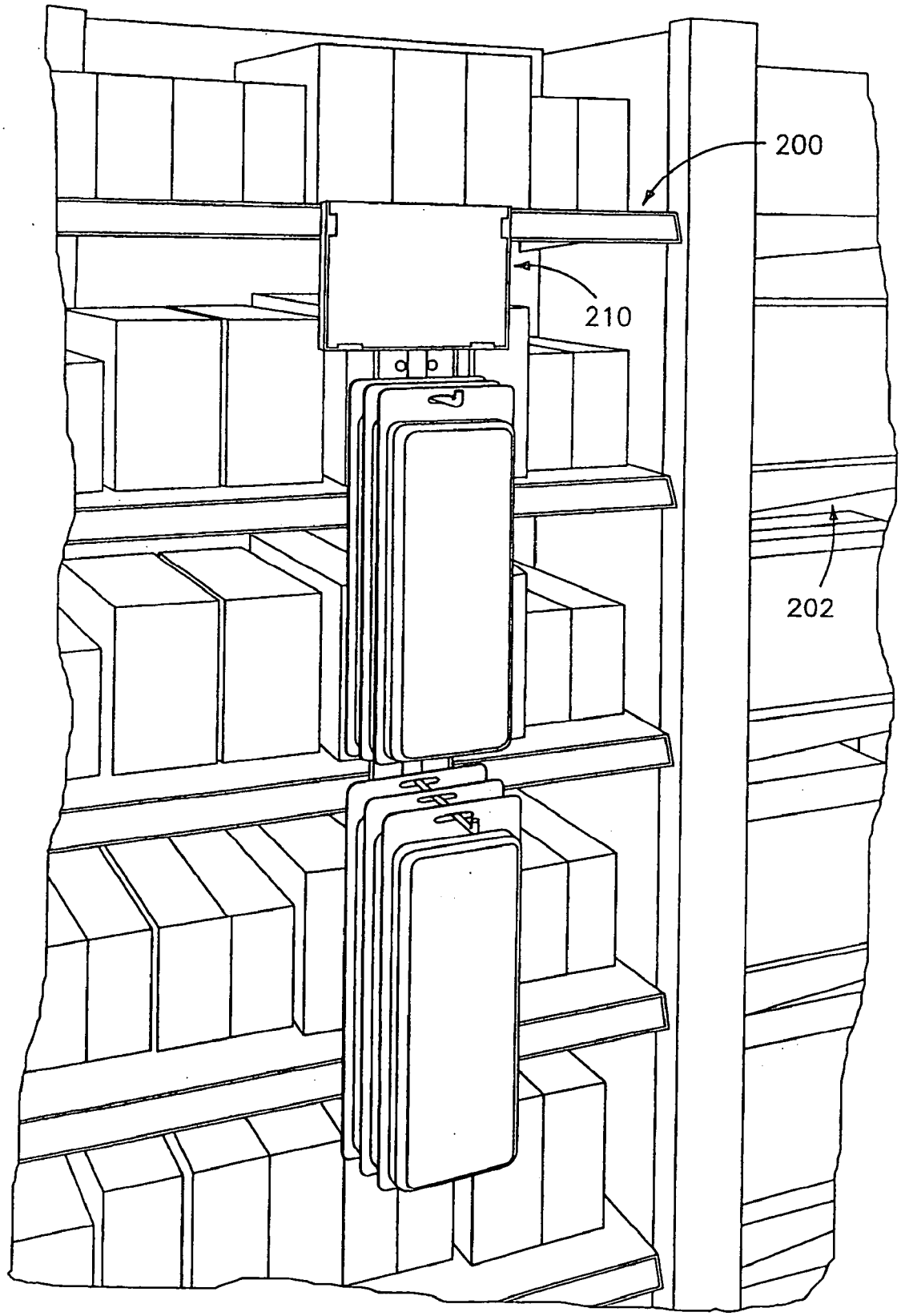
FIG. 23 is a view of an assembled display in a shelf-mounted clip strip configuration.
Figure 24:
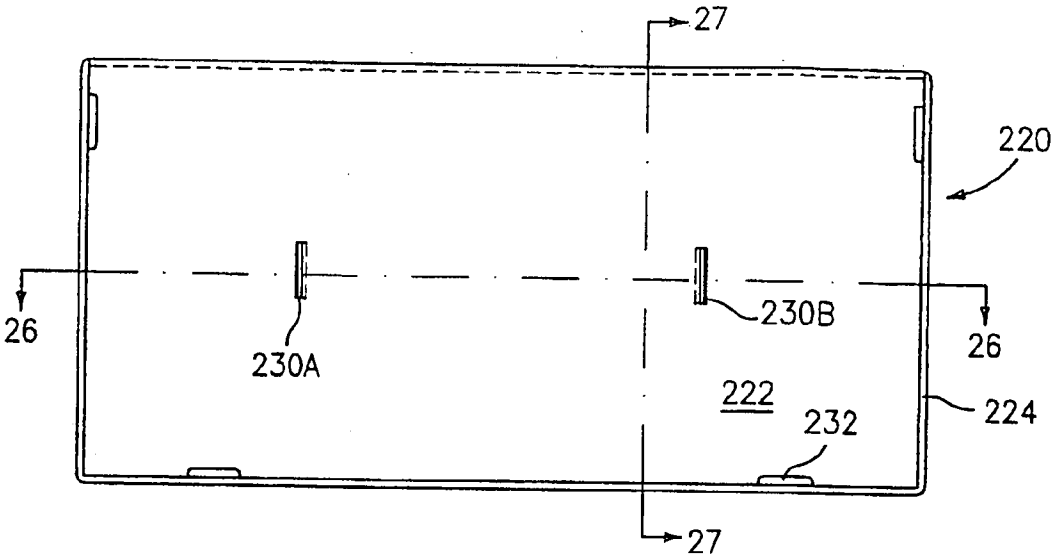
FIGS. 24 and 25 are front and bottom views of a header adapter.
Figure 25:
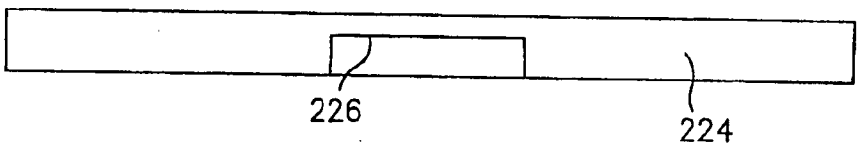
Figure 26:
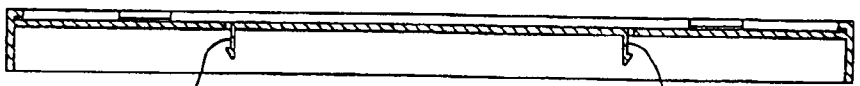
FIG. 26 is a transverse cross-sectional view of the adapter of FIG. 24, taken along line 26—26.
Figure 27:
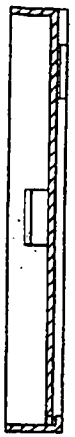
FIG. 27 is a side cross-sectional view of the adapter of FIG. 24, taken along line 27—27.

FIG. 22 shows an installed display in an environment featuring primary gondola shelving 200, end cap shelving 202 and a wire rack power wing 204. The assembled display 206 is mounted to the proximal side of the wire rack 204 in a mini-wing configuration which, in the exemplary embodiment, includes four tray-carrying fixtures. FIG. 22 shows the trays carrying exemplary products formed as tall boxes. The front-to-back declination of the trays provided by the fixtures relative to the vertical spine provides stability and helps maintain the product within the tray despite the relatively high product height in view of the relatively low tray front wall. Not shown in FIG. 22 is an exemplary spacer insert which elevates a back row of product in each tray relative to the front row. FIG. 23 shows a display 210 mounted to primary shelving 200 as a so-called hook strip (a clip-strip configuration also typically being similarly positioned) where the display is located in front of primary product being displayed on the shelving 200.

It may be useful to adapt the display system for use in a wider environment than the relatively narrow mini-wing or hook strip configurations. In such a situation, relatively wide versions of the hooks with multiple or widely-spaced shafts may be provided. Additionally, adapters may be provided to increase the effective widths of the header and the tray-carrying fixtures. By way of example, FIGS. 24–27 show an adapter 220 for increasing header width. The adapter, has a web or body portion 222 circumscribed on all sides by a flange 224 similar to that of the header 20. In its bottom, the flange has a relief or cutout 226 extending forward from the rear edge thereof and dimensioned to accommodate the spine 22 when the adapter 220 is placed over the header 20. A pair of left and right barbed projections 230A and 230B are provided to be accommodated by associated apertures 231A and 231B in the header 20 (FIG. 2) to releasably secure the adapter to the header. The adapter may have features 232 for receiving a relatively wide graphic panel in similar fashion to the header. A shelf adapter 240 includes an upper platform portion 242 (FIG. 29) with various structural ribs depending therefrom. An area 244 between various ribs is dimensioned to accommodate the base portion 150 of the fixture 34. Depending from the platform 242 within the area 244 a barbed projection 246 is provided to engage the underside of the fixture platform portion 152 (e.g., at the root of the projection 186 of the fixture base). Ahead of the projection 246, an aperture is provided in the platform 242 to accommodate the projection 186. The projection 186 has sufficient height to extend sufficiently above the upper surface of the platform 242 to engage a complementary central aperture at the rear extremity of the tray bottom wall.

Figure 30:
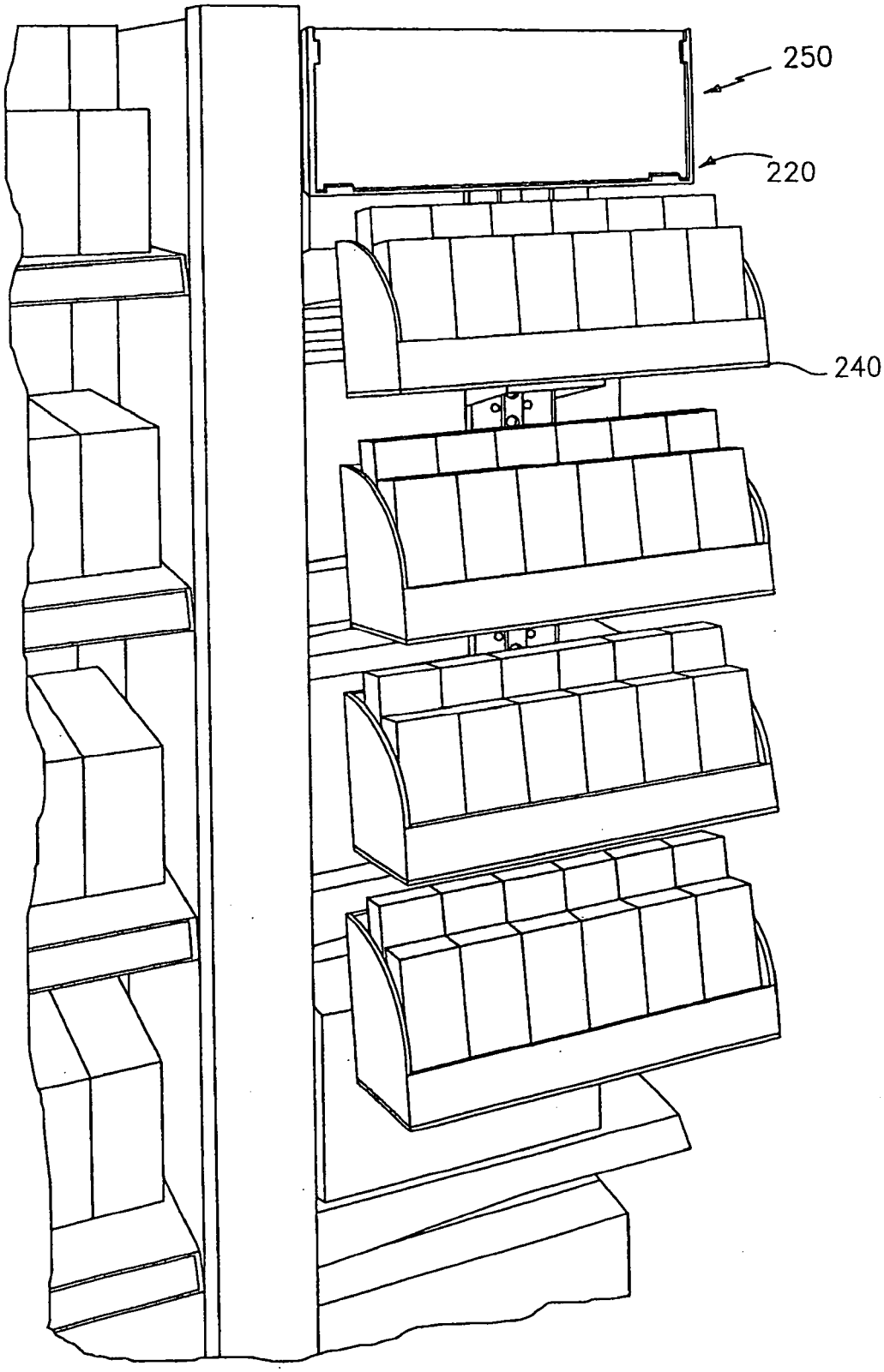
FIG. 30 is a view of a display in a power wing configuration utilizing header and tray-carrying fixture adapters.

FIG. 30 shows a display system 250 in a power wing-configuration utilizing a relatively wide header adapter and relatively wide fixture adapters to accommodate relatively wide trays.

FIGS. 31 and 32 show an adapter 258 provided to permit mounting of the fixture 34 directly to a pegboard wall in the absence of the exemplary spine. The adapter includes a plurality of spaced-apart prongs 260 for engaging holes in the pegboard wall. The prongs extend rearward from the top of a plate 261. The plastic adapter 258 is unitarily molded with a pair of upwardly open hooks 262. The hooks extend forward from associated molding apertures (windows) in the plate 261 and are open along outboard edges. Along inboard edges, the hooks meet outboard surfaces of vertical walls 263 which extend rearward to join the plate 261 along the inboard edges of the molding apertures. The walls 263 provide the hooks with structural integrity. The plate 261 and each hook 262 form a J-sectioned channel 265. When the adapter is engaged to the pegboard wall, the fixture 34 may be downwardly engaged to the adapter so that the fixture upper fingers 140A and 140B are captured by the channels 265 to support the fixture. The tray may be installed on the fixture as described above.

Figure 33:
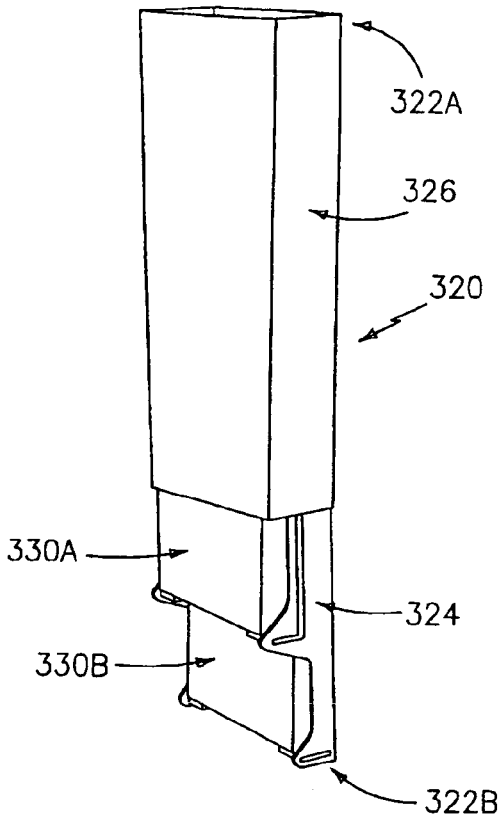
FIG. 33 is a view of a chute-type dispenser, containing two groups of articles.

FIG. 33 shows a dispenser 320 formed as a chute assembly. The assembly extends from an upper end 322A to a lower end 322B. The assembly is formed of a vacuum-formed and subsequently folded polystyrene core element 324 and a corrugated cardboard shroud 326 wrapped around an upper portion of the core.

The core is vacuumed-formed to provide appropriate convolutions which, when the core is folded provide features for defining one or more product flow paths from an inlet proximate the upper end 320A to an outlet area between the lower end 322B and a lower front edge of the shroud 326. The flow paths accommodate associated groups of articles 330A and 330B. The articles are stacked along the associated flow paths and gravity feed from uppermost positions within the assembly proximate the upper end 322A to lowermost positions shown in FIG. 33. The articles are retained in their associated lowermost or delivery positions by appropriate portions of the convolutions.

Figure 34:
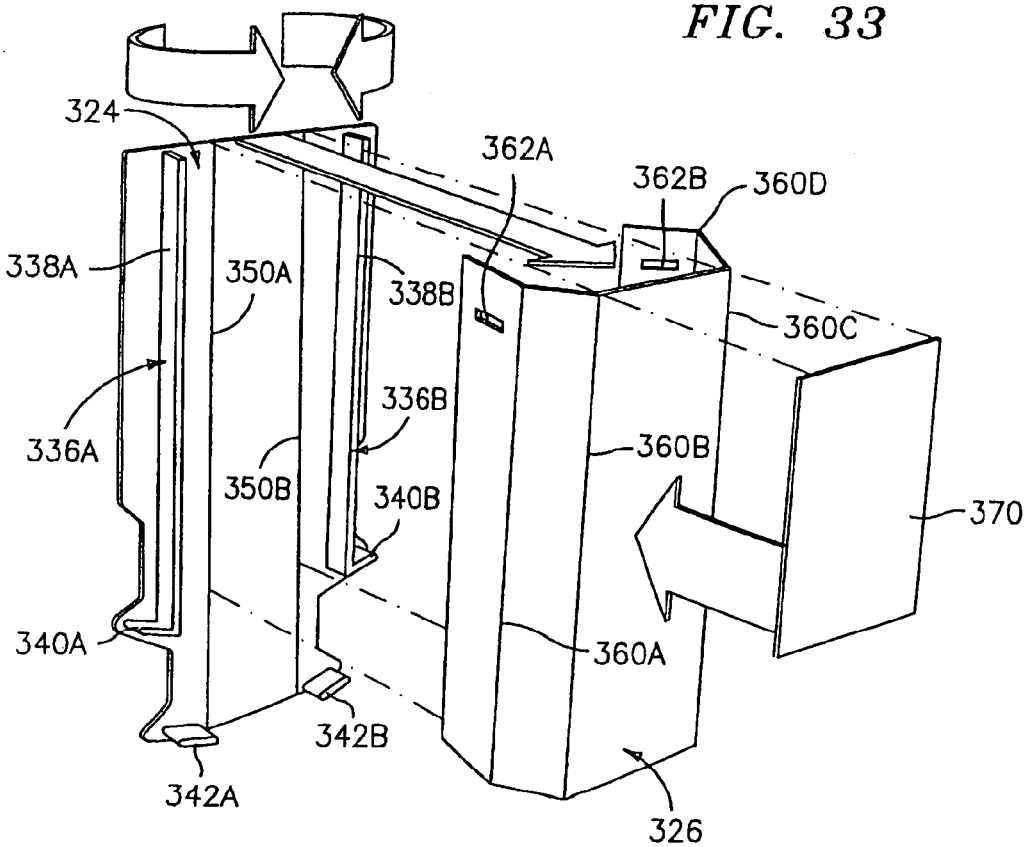
FIG. 34 is an exploded view of the dispenser of FIG. 33.

In the exemplary embodiment, the convolutions (FIG. 34) include left and right divider walls 336A and 336B which separate the two flow paths along left and right sides of the dispenser and which have respective vertical upper portions 338 and 338B and partially horizontal lower portions 340A and 340B acting as stop members for retaining the lowermost article in the front flow path until it is removed. Additionally, the convolutions include left and right stop members 342A and 342B for the rear flow path. A user may grasp an article from beneath through the gap between the associated stop members and pull the article forward and out of the dispenser, allowing the remaining articles in the associated flow path to descend to provide a newer lowermost article in that flow path.

To assemble the dispenser, the core 324 is vacuumed formed in the factory and then in the factory or field folded along predefined left and right fold lines 350A and 350B, the area between the fold lines forming a rear panel of the core and the areas beyond forming left and right sides of the core. Pressure-sensitive, double-stick, adhesive tape (not shown) may be applied to the rear surface of the rear panel. The shroud 326 is die cut in the factory an then in the factory or field folded along fold lines 360A–360D to define front, left and right side, and a pair of overlapping rear panel portions of the folded shroud. Graphics and/or decorations may be applied prior to cutting, prior to folding, or anytime there-after. The overlapping rear portions include respective apertures 362A and 362B which align with each other when the shroud is folded around the core, the inward of the two overlapping portions becoming affixed to the chute via the adhesive tape. Such adhesive may be located at additional locations along the outer surface of the core to secure the core to the shroud at additional locations. A clip (not shown) such as clip 26A of FIG. 1 may be inserted through the co-aligned apertures 362A and 362B to hang the assembled dispenser from a rack (not shown) in a mini-wing configuration. An optional adhesive graphic label 370 may be applied to the exterior surface of the front panel portion of the shroud 326.

Figure 36:
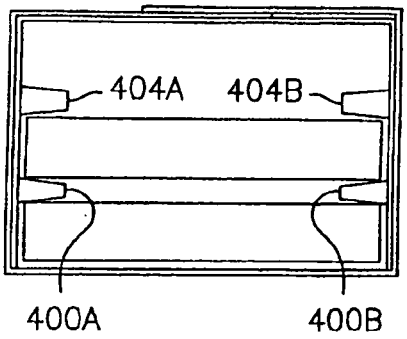
FIGS. 36–40 are top views of alternate dispensers.
Figure 37:
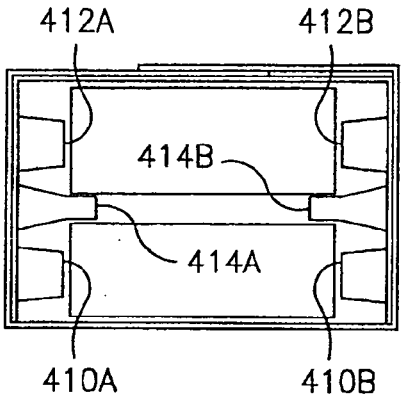
Figure 38:
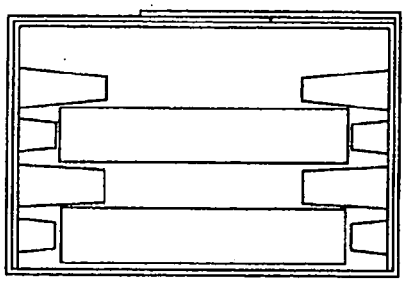
Figure 39:
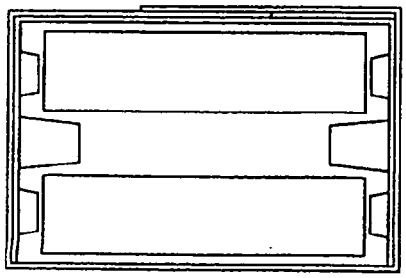

Within a given overall dispenser sectional envelope (e.g., 5 in. wide by 4 in. deep) a variety of different sizes of articles may be accommodated by appropriate configurations of the convolutions in the core. FIGS. 36–39 are top views of alternate configurations for accommodating articles of different sizes (e.g., widths and depths when viewed in the dispensing orientation). Article heights may be accommodated by adjusting the height of the exposed portions of the flow paths below the shroud (which may involve altering the shroud height or the dispenser height). By way of example, with articles having a relatively low depth, FIG. 36 provides a first pair of convolutions 400A and 400B separating the two flow paths and a second pair of convolutions 404A and 404B offsetting the rear flow path forward to accommodate the extra available depth. To accommodate articles of relatively small width, the convolutions may include first and second pairs of spacers 410A, 410B and 412A, 412B to engage left and right ends of the articles in their associated flow paths to maintain such articles transversely centered within the dispenser. Divider convolutions 414A and 414B may be provided having sufficient dimensions to maintain front-to-back alignment of the articles in the flow path. The dispenser of FIG. 38 combines the width and depth-related features of the dispensers of FIGS. 36 and 37. The dispenser of FIG. 39 provides a relatively smaller degree of width offset and a relatively higher degree of front-to-back separation than does the dispenser of FIG. 37.

Figure 40:
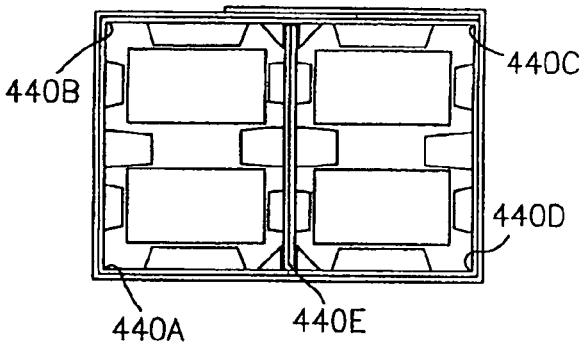
Figure 35:
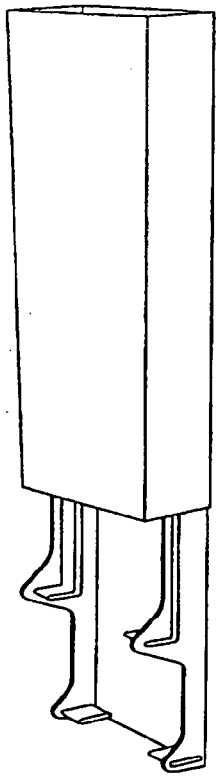
FIG. 35 is an empty view of the dispenser of FIG. 33.

The dispenser of FIG. 40 provides four flow paths in two tandem arrangements with an outer insert folded at lines 440A–440D and a divider folded along line 440E. Alternatively, a single piece insert may be formed and folded along seven fold lines with an overall section similar to a squared-off, pigeon-toed, "M". Alternatively, two cores may be formed separately and secured side-by-side within the single shroud. The manufacturer can form the cores in dimensions for use with various standard product sizes (e.g., standard sizes for boxes of various cosmetics and toiletries). A vendor that makes product in various sizes can order a limited variety of shrouds having graphics tailored to its particular products or product groups. The vendor still has flexibility to choose the appropriate size or combination of sizes to of its products to be dispensed by selecting the appropriate core or combination of cores to associate with a particular shroud.

Figure 42:
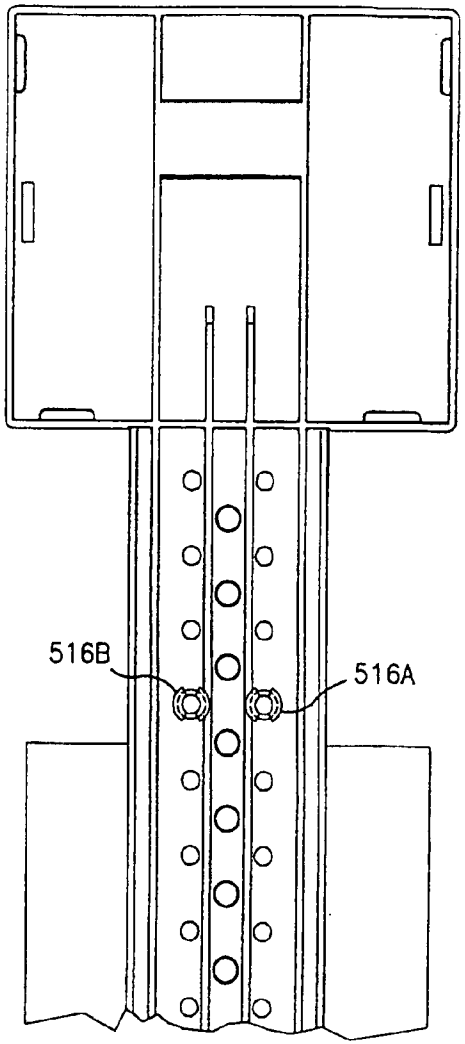
FIGS. 41 and 42 are front and rear views of an alternate tray and mounting configuration.
Figure 41:
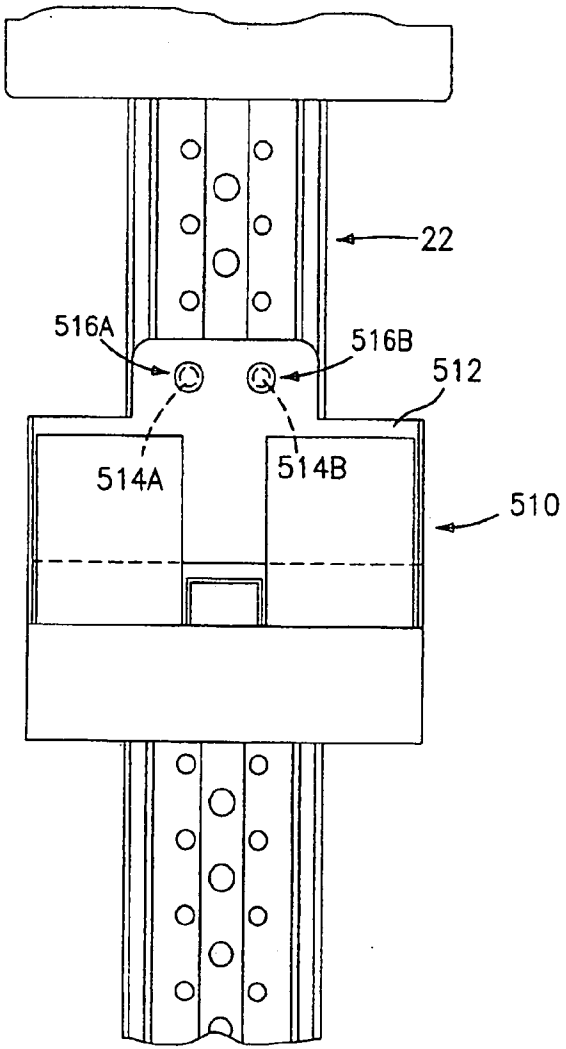

FIGS. 41 and 42 show an alternate system for mounting a tray 510 to a spine 22 in the absence of a supporting shelf. The tray back wall 512 is provided with a pair of left and right holes 514A and 514B. The holes may be formed in a variety of ways such as through all layers of multi-layer back wall (see FIG. 1) or in a tab such as extending upward from one layer and having been cut from another. The holes are advantageously positioned to align with a pair of the exemplary holes 82A and 82B in the spine. However, for improved structural strength, the holes 514A and 514B may be vertically offset from each other (as in FIG. 1). A pair of fasteners 516A and 516B extend through the holes 514A and 514B, the undersides of the fastener heads engaging the front surface of the back wall or projecting tab. A barbed gripping portion of the shaft of each fastener extends through the associated hole 82A and 82B, engaging the back surface of the spine to resist withdrawal of the fastener and thus secure the tray to the spine (FIG. 42). Exemplary fasteners are dart clips and Christmas tree clips, with a preferred Christmas tree clip available from FFR as part 8502477405.

Figure 43:
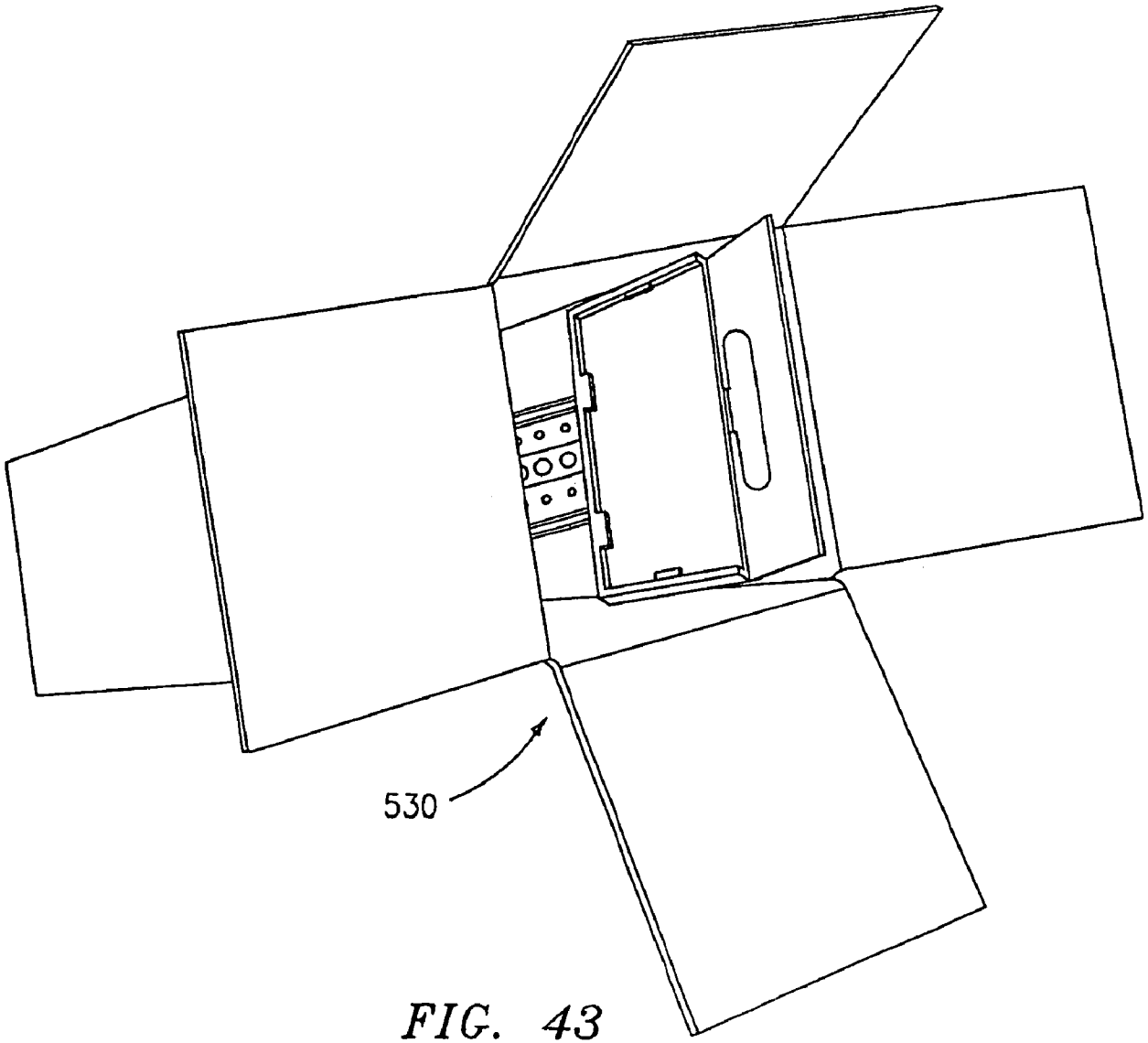
FIGS. 43 and 44 are views of a pre-assembled system in two stages of removal from a shipping carton.
Figure 44:
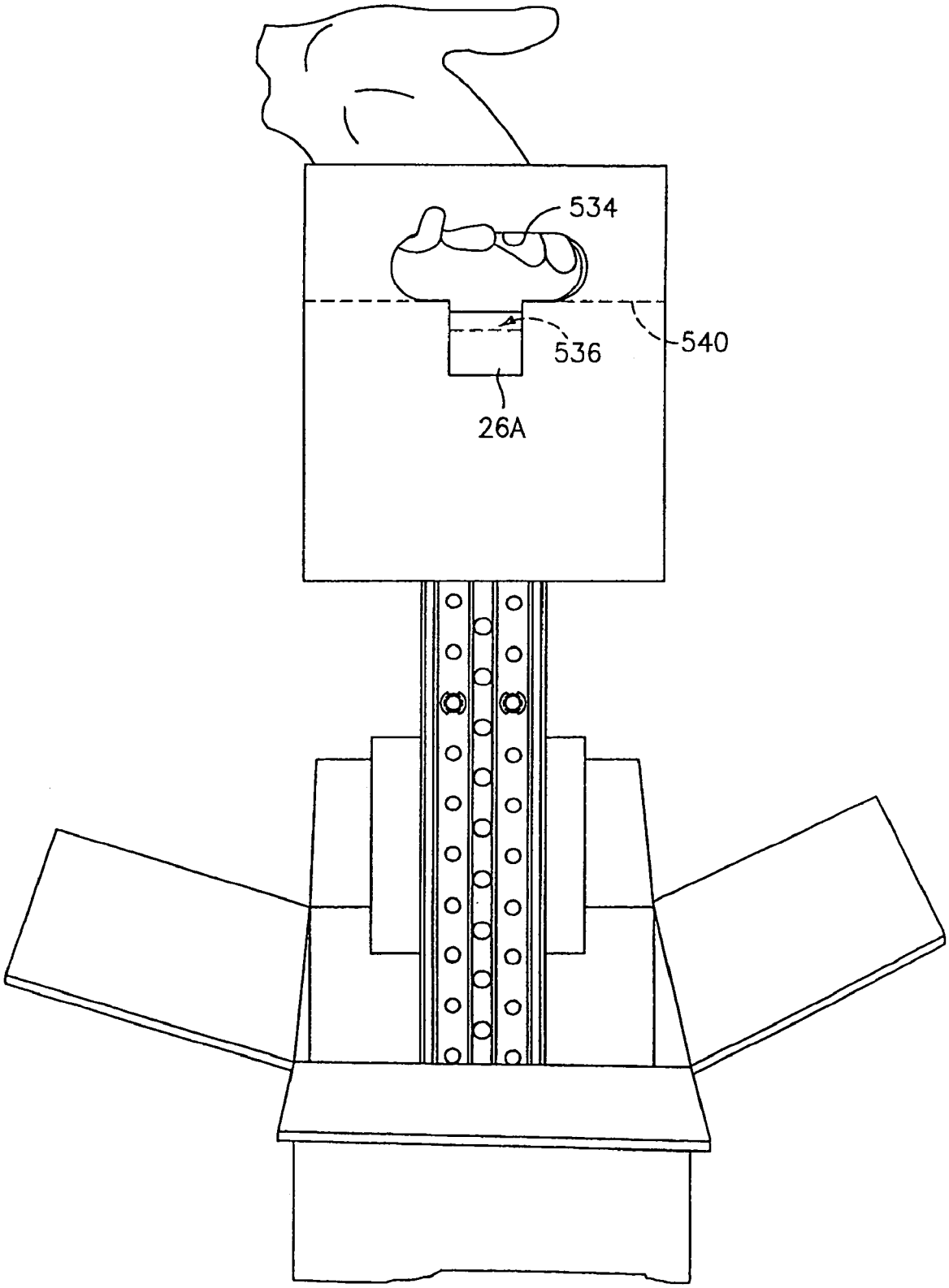

It may be advantageous to ship displays pre-assembled, with various product-holding elements already full of their associated product. FIG. 43 shows an open end of a box 530 containing such a display. The exemplary box is elongate and opens at one of its small ends. With the end adjacent the header open, a handle 532 is provided secured to the header. A user may grip the handle (such as via insertion of the user's fingers through an elongate capsule-shaped opening 534 (FIG. 44)). The exemplary handle 532 is formed of a rectangular sheet of corrugated cardboard. The opening 534 includes a rectangular annex 536 depending from a capsule-shaped portion and which captures the upper mounting element or clip 26A while such clip compressively grips the front and back surfaces of the handle below the region 536. For compactness, when the box is closed, the handle may be folded forward 90 degrees about a fold line 540 at approximately even level with an upper portion of the region 536. When the box is open, the handle unfolds so that its portions above and below the fold line 540 are approximately coplanar, permitting gripping by the user. Once the display has been extracted, the user may grip the spine and then lower the handle to disengage it from the clip, whereupon the handle may be discarded and the display installed to the appropriate rack.

Figure 46:
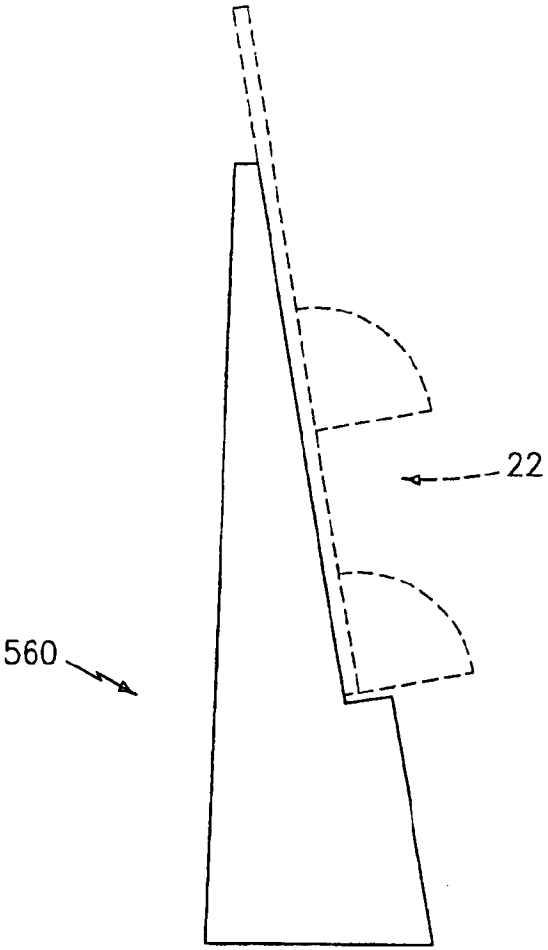
FIGS. 45 and 46 are using a freestanding base for the display of FIG. 1.
Figure 45:
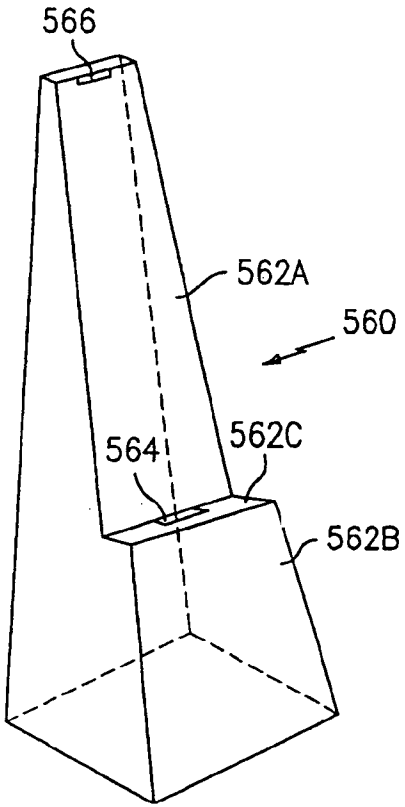

FIGS. 45 and 46 show a corrugated cardboard base or support stand 560 for supporting the display 20 in a free-standing mode. The stand 560 includes four lateral sides (with respective faces) generally tapering from bottom to top. The front side is stepped having an upper portion 562A, a lower portion 562B and a step portion 562C. The step portion, is preferably substantially perpendicular to the upper portion and advantageously to the lower portion as well. Along the junction of the step portion rear edge and upper portion lower edge, the step portion includes a rectangular cutout 564 having dimensions complementary to the cross-sectional dimensions of the spine for receiving a lower end portion of the spine. Depending from an upper edge of the upper portion, a cutout 566 is provided having dimensions effective to capture and locate the clip 26A. To install the spine 22, it is lowered parallel to the upper portion 562A so that the clip grasps the upper portion and is in turn captured by the cutout 566 while the spine lower end portion is captured by the cutout 564.

Figure 47:
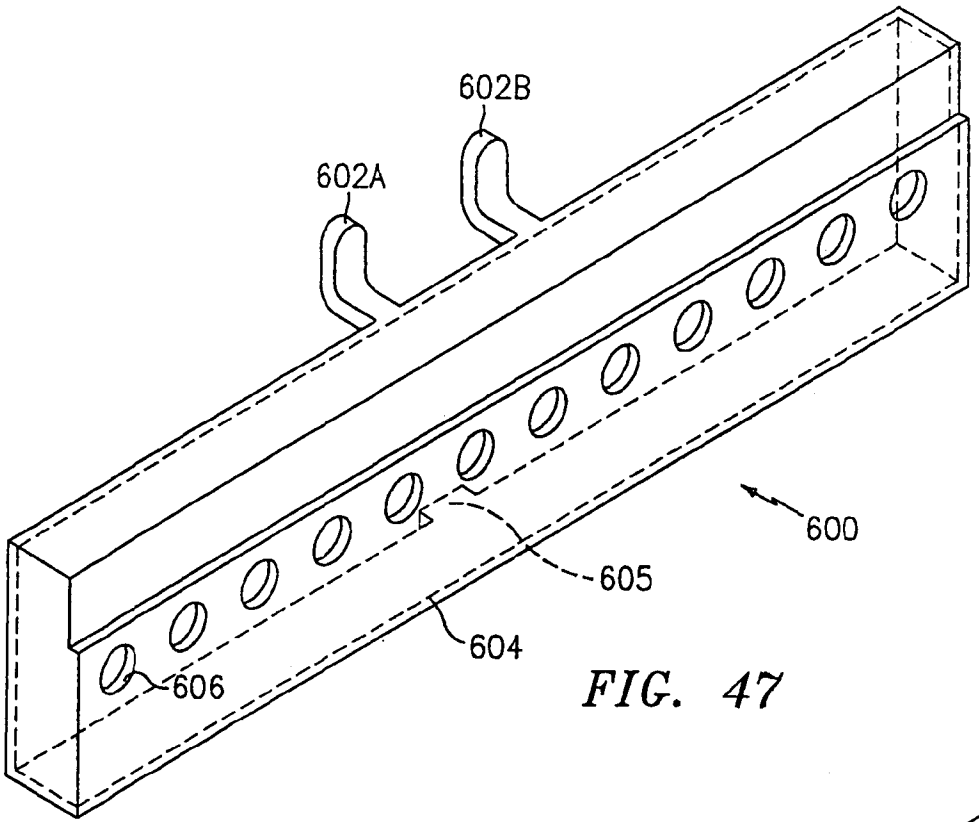
FIG. 47 is a view of a first hook adaptor.
Figure 49:
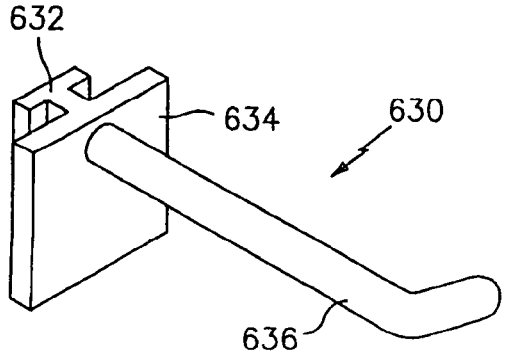
FIG. 49 is a view of a hook for use with the adaptor of FIG. 48.

FIG. 47 shows a hook adaptor 600 having mounting projections 602A and 602B similar to those described above extending from an upper wall of a transversely extending channel portion 604. A projection 605 extends directly rearward from the lower wall of the channel portion. The projections 602A and 602B are positioned and dimensioned to engage a corresponding pair of the holes 82A and 82B while the projection 605 is positioned and dimensioned to simultaneously engage an associated aperture 80 for enhanced stability. The front wall of the channel portion includes a transverse array of apertures 606 dimensioned to themselves receive appropriate mounting projections of mounting hooks and the like. This permits use of multiple mounting hooks at a given vertical position. The apertures 606 may have an on-center pitch equal to or preferably half of the standard mounting projection pitch (e.g., half of one inch) to provide greater control over mounting hook spacing.

Figure 48:
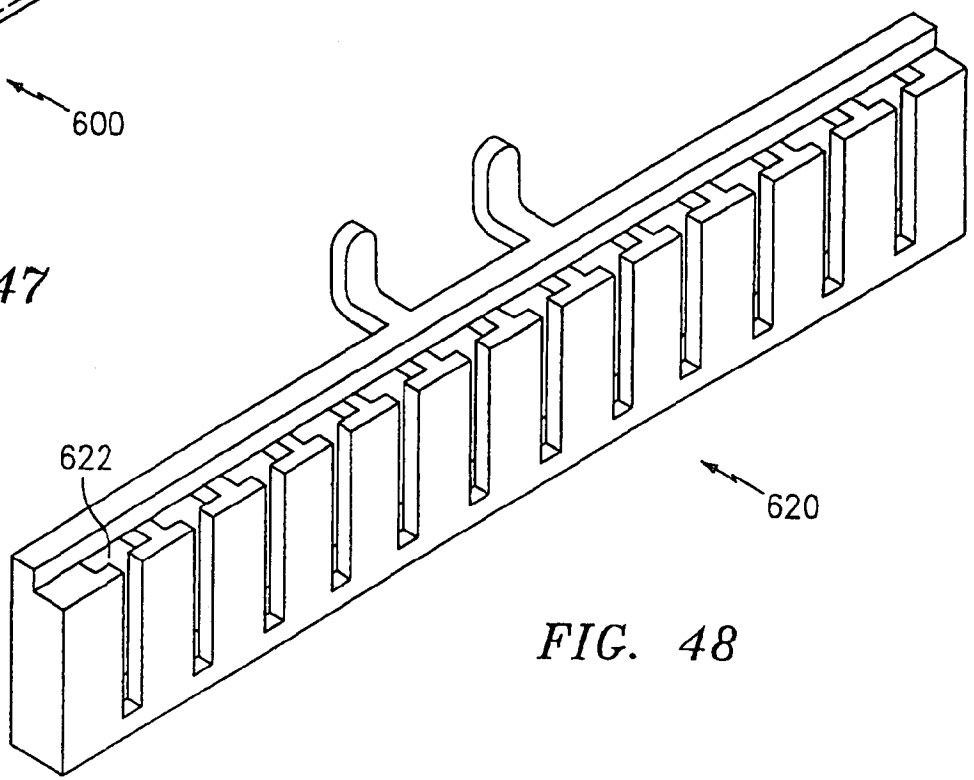
FIG. 48 is a view of a second hook adaptor.

FIG. 48 shows an alternate system for providing hooks at a given level. Rather than having the particular apertures shown in FIG. 47, the embodiment of FIG. 48 includes a horizontal array of vertically-extending channels 622. To mate with such channels, hooks 630 are provided having a complementary vertically-extending projection 632 extending back from a base plate 634, with a hook shaft 636 extending forward therefrom. The projection 632 may be slid downwardly into engagement with a channel 622 until a lower portion of the projection 632 contacts a terminus portion of the channel 622.

Figure 50A:
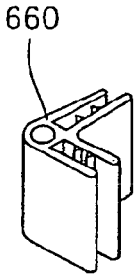
FIG. 50 is a partially exploded view of an alternate display.
Figure 50:
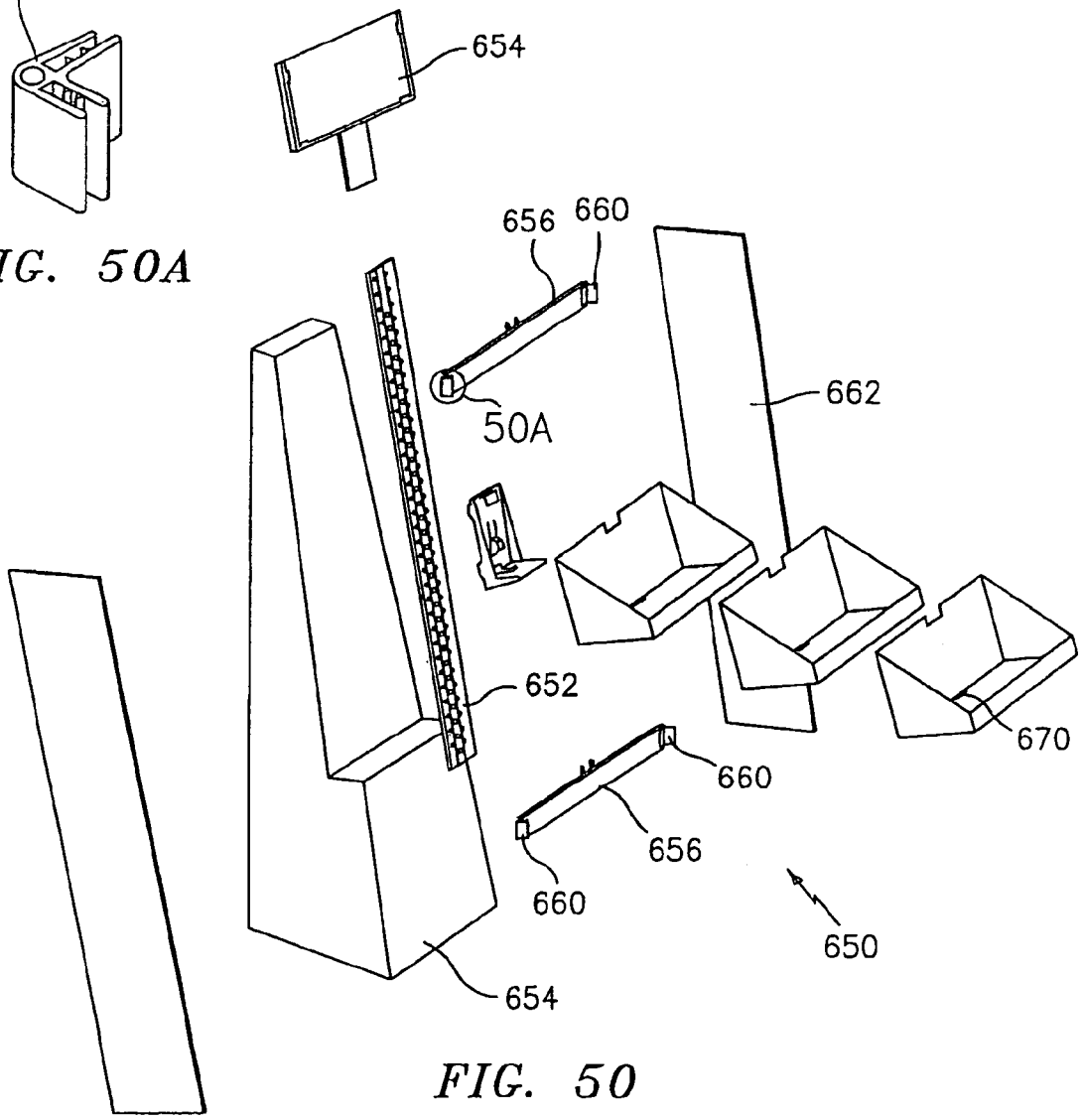

FIG. 50 shows an alternate display system 650. A spine 652 and header 654 may be separately formed or may be unitarily formed as described above. Separate forming may ease certain manufacturing factors. It allows spine materials to be manufactured in very long lengths and multiple spines to be then cut from an individual piece. A base 654 may be similarly formed to that described above. The display includes a pair of upper and lower one-piece molded plastic crossmembers 656. Each crossmember 656 (FIGS. 51 and 52) includes a transversely-extending vertical wall and features such as a pair of upper prongs 658 and a lower projection 659 extending from the back of the wall for mounting the crossmember to the spine. In the exemplary embodiment, the prongs 658 are dimensioned and positioned to engage the left and right array of engagement holes while the projection 659 is positioned and dimensioned to engage the central array of engagement holes. At left and right ends, each crossmember carries a two-way (90°) extruded plastic panel former. An exemplary panel former is available from FFR as part 811 81103 00. One arm or branch of the panel former grasps the central web of the wall 657, with internal teeth gripping front and back surfaces of the web. The other arm of the panel former projects forward. The presence of a pair of left and right upper panel formers and left and right lower panel formers on the upper and lower crossmembers, respectively, permits the display to carry a pair of left and right corrugated side panels 662. The forwardly-projecting panel former arms grip inboard and outboard surfaces of the associated panel around a rear edge thereof. The panels extend forward from the panel formers, and can carry signage or the like. The panels also help conceal structural aspects of the display. Such crossmembers and panels may also be used in mini-wing and power wing display configurations in the absence of the base. Additionally, FIG. 50 shows that various sizes of tray (three different depths being shown) may be utilized with a given fixture. FIG. 50 also shows the tray bottom wall aperture 670 which may accommodate the projection 186 of FIG. 21.

Figure 53:
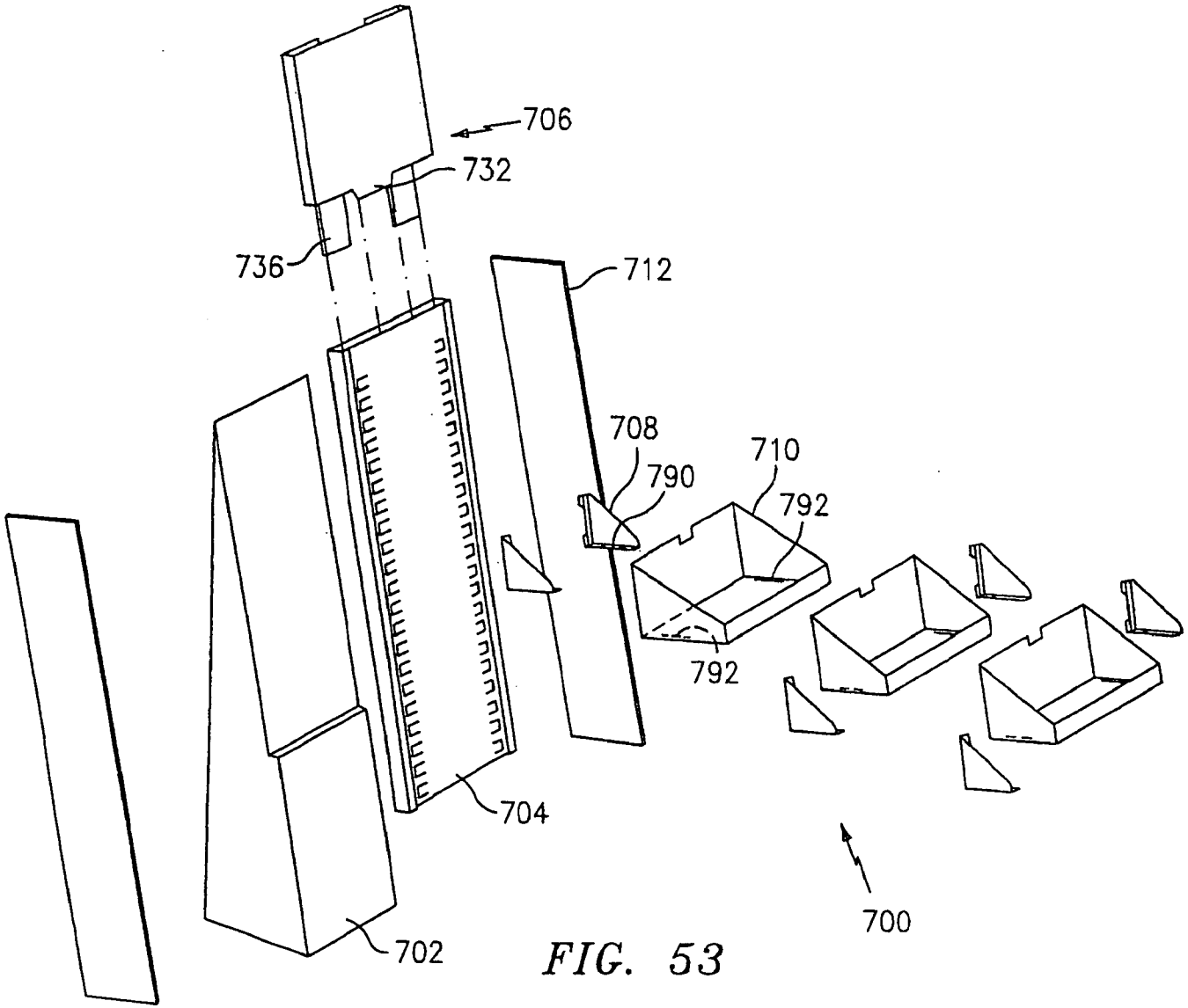
FIG. 53 is a partially exploded view of an alternate display.
Figure 54A:
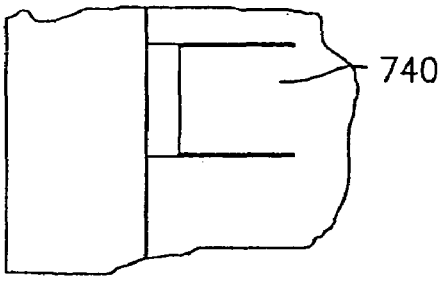
FIG. 54 is a view of a panel of the display of FIG. 3.
Figure 54:
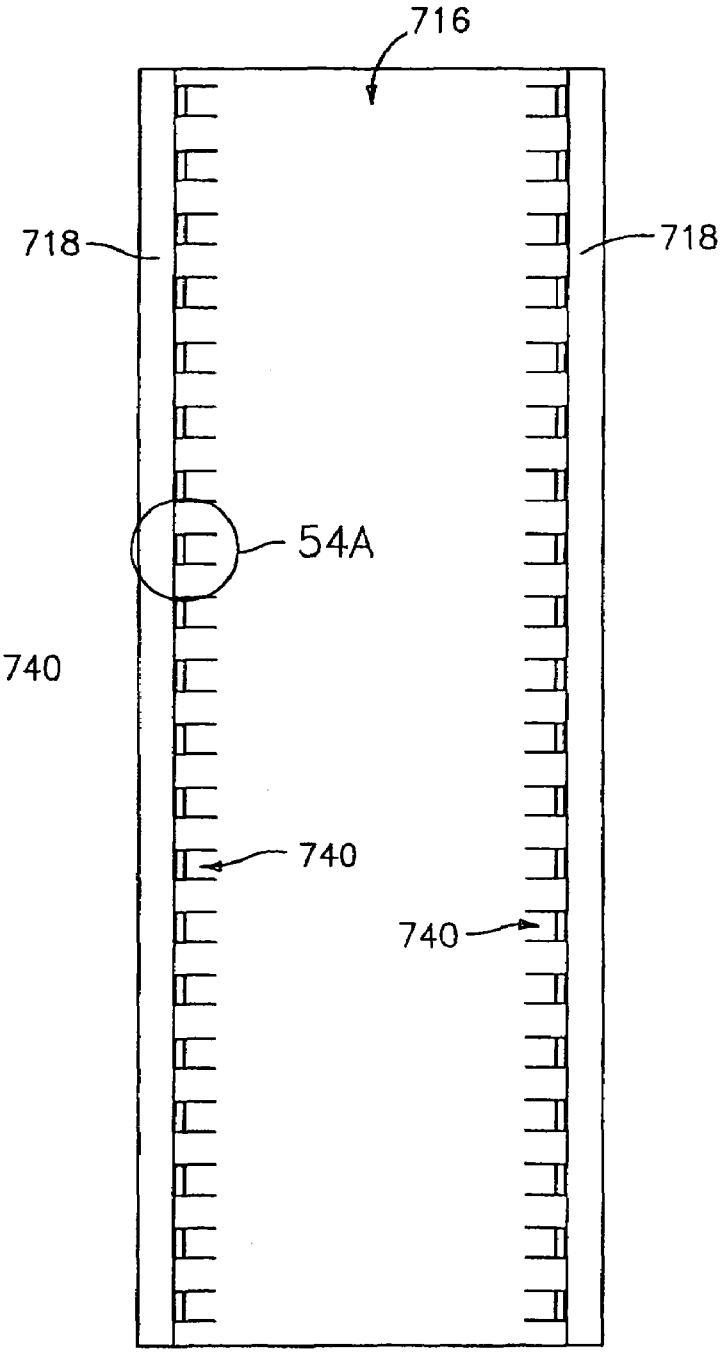
Figure 55:
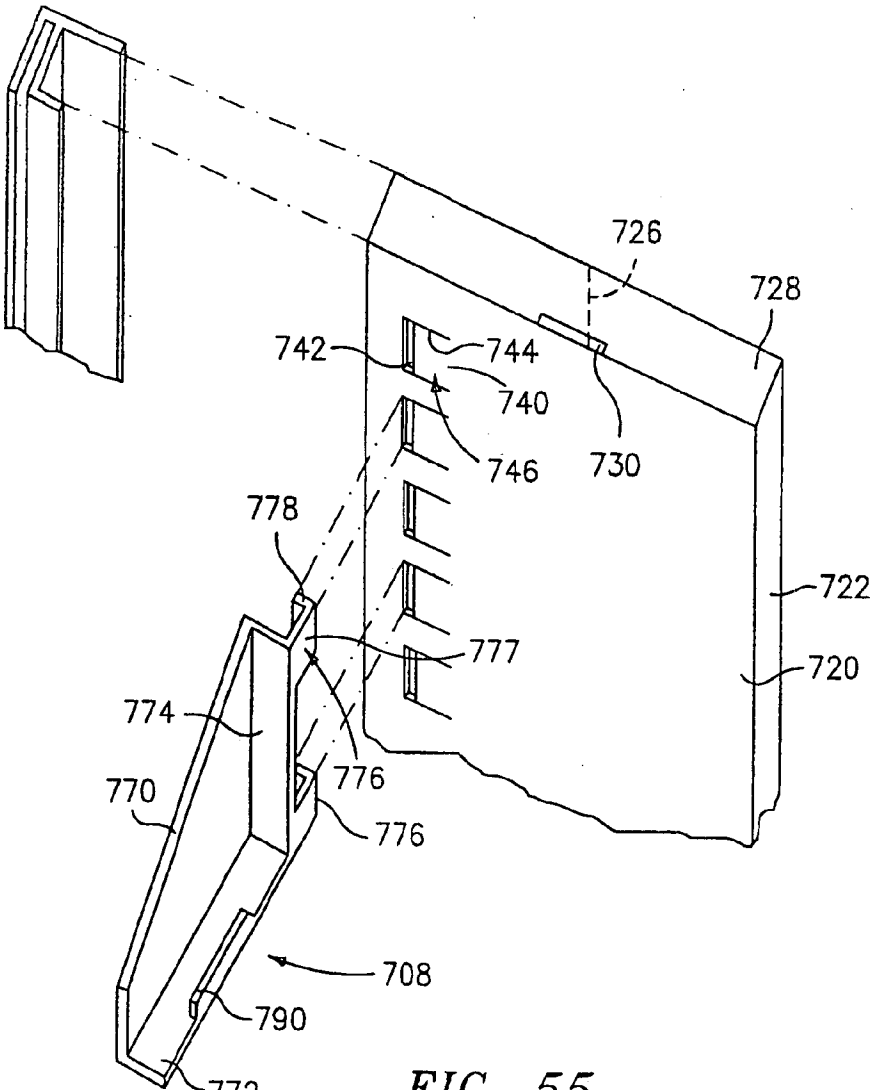
FIG. 55 is a partial exploded view of the panel of FIG. 54.

FIG. 53 shows an alternate display 700 including a corrugated board base 702, a back panel assembly or chassis 704, a header 706, and a plurality of pairs of one-piece molded plastic shelf brackets 708, each associated with a tray or shelf 710. Optionally, a pair of corrugated board side panels 712 may be provided. The back panel assembly 704 is formed of a central corrugated board member 716 and a pair of left and right extruded plastic frame members or side rails 718 (FIG. 54). The corrugated member 716 may be formed in a variety of ways. In one example, it is die cut and folded so that a central portion of the die cut element becomes a front 720 (FIG. 55). The member is folded around vertical front edges to provide sides 722 and vertical rear edges to provide a back 724 (two portions of the back meeting along a seam or junction 726 or overlapping). A top 728 is folded along an upper front edge and has a lip (not shown) tucked in front of an upper extremity of the back 724.

A central aperture 730 is formed in the top 728 along the upper front edge for engaging a tab or projection 732 of the header 706. The exemplary header 706 may be formed of corrugated board folded along vertical fold lines so that a central portion becomes a front from which the tab 732 centrally depends. Outboard portions fold toward each other to become a partial back portion of the header and each may include depending tab 736. When assembled to the panel assembly 704, the header back tabs 736 may extend between the top 728 and back 724 or may be secured (such as via adhesive) behind the back 724. If so secured, for transport and storage the header may be folded back at an effective hinge along root portions of the projections 736 and then rotated forward so that the tab 732 mates with the aperture 730 in a deployed condition.

Along sides of the front 720, the member includes pairs of vertical arrays of engagement features 740 for accommodating the shelf brackets. The engagement features are formed having outboard rectangular apertures 742 and cut lines 744 extending inboard from upper and lower edges of the aperture 742. The cut lines 744 define tab portions 746 extending outboard from an inboard root to the apertures 742.

Figure 56:
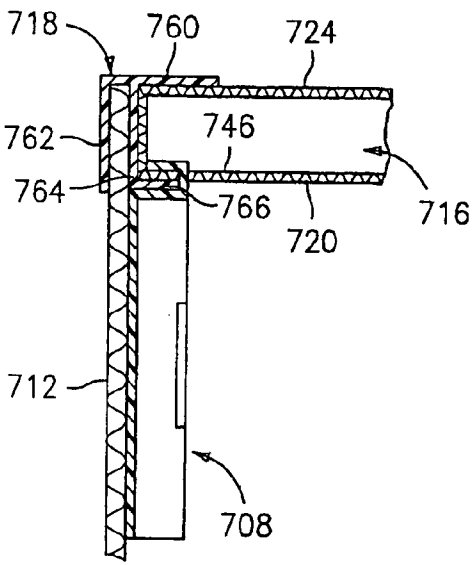
FIG. 56 is a partial transverse sectional view of the panel of FIG. 54.

FIG. 56 shows each side rail 718 defining a first transverse channel for receiving and gripping the folded corrugated member 716 along peripheral portions of its front and back and the adjacent side. A second channel receives and grips an aft peripheral portion of the associated side panel 712. In its exemplary form, the rail is defined by a back wall 760, an outboard side wall 762 extending forward from an outboard edge of the back wall, an inboard sidewall 764 extending forward from the back wall parallel to and spaced apart from the outboard sidewall 762 and a front wall 766 extending inboard from the forward edge of the inboard side wall 764. The walls 766 and 764 and the inboard portion of the wall 760 define the first channel while the walls 762 and 764 and the outboard portion of the wall 760 define the second channel. When assembled to the member 716, the side rail front wall 766 extends inboard to approximate registry with the outboard edge of each associated aperture 742.

Each shelf bracket 708 includes an outboard sidewall 770, a bottom wall 772 extending inboard from a lower edge of the sidewall, and a back wall 774 at rear edges of the walls 770 and 772. The bracket includes a pair of upper and lower engagement features 776. The engagement features 776 include a first portion 777 extending aft from an inboard edge of the back wall 774 and a second portion 778 extending outboard from the aft edge of the first portion so that the second portion and back form channel walls and the first portion forms a channel base. The engagement features 776 are spaced apart by an integer multiple of the spacing of the engagement features 740.

Each bracket 708 may be assembled to the member 716 either before or after the side rails. In order to do this, the bracket is moved rearward so that its engagement features come into contact with the tabs 746 of two associated engagement features 740, flexing the tabs backward until the bracket engagement feature second portions 778 have moved close to or just behind the front 720. The bracket may then be shifted outboard so that its engagement feature channels grasp the rail front wall 766 and adjacent outboard portion of the front 720. Each aperture 742 is of sufficient width to accommodate an engagement feature first portion 777 so that the tab may flex back to its initial transverse position so that its outboard edge engages the inboard surface of the portion 777 preventing removal of the bracket unless and until a user manually flexes the tab (acting as a latch) backward out of engagement. Alternatively, the brackets may first be installed to the member 716 and then the side rails shifted inboard so that their front walls 766 are sandwiched between the bracket back wall 774 and the panel front 720. Friction fit or adhesive may be sufficient to secure the side rails in place. Friction fit or adhesive may also be sufficient to hold the side panels 712 in the side rails.

Each bracket includes a projection 790 extending upward from an inboard edge of its bottom 772. The projection 790 is dimensioned and positioned to be accommodated within a slot 792 formed in the bottom of the tray 710 adjacent to the associated side edge thereof (FIG. 53) The exemplary trays shown in FIG. 53 have such features for engaging the bracket 708 and features for engaging shelf supports as previously described. With the trays installed in the brackets, the bracket bottom portions support associated side peripheral portions of the tray bottom with the projections 790 and slots 792 resisting forward translation of the tray.

Figure 57:
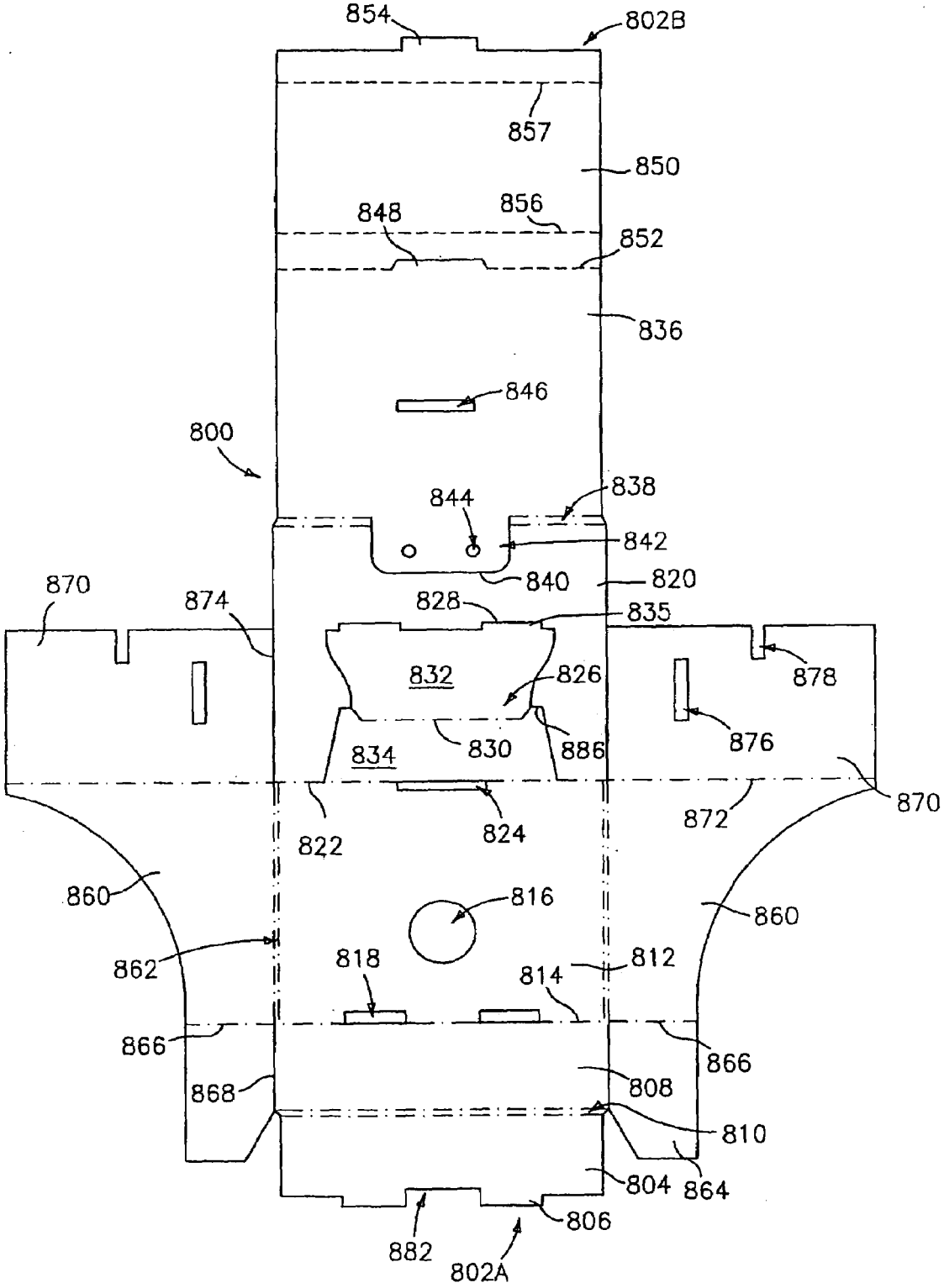
FIG. 57 is a top view of a tray-forming blank.

FIG. 57 shows ray-forming blank 800 which may be die cut from a larger piece corrugated stock and then folded to form a tray. In the drawing of the exemplary blank: solid lines show complete cut-through by the die; evenly dashed lines show scoring which may help define fold lines to facilitate folding; and alternating dash-dot lines show linear embossment which may also help define fold lines to facilitate folding. In a number of locations, close parallel embossments are shown which define a single effective fold line but facilitate a more gradual fold as may be appropriate when multiple layers of material are involved. The blank has first and second opposed planar faces in its pre-assembly (pre-folding) initial condition and extends longitudinally from a fore or front end 802A to an aft or rear end 802B. Directional terms such as fore and aft are used in a relative sense although, as will be seen, they may in large part correspond to a preferred assembled orientation. The exemplary blank has a foremost first portion 804 having a pair of tabs 806 at its fore end. A second portion 808 is located principally aft of the first portion (i.e., a major part of the second portion is aft of a major part of the first) and at least in part meets the first portion along a fold line 810. The exemplary fold line 810 is formed by a pair of closely-spaced parallel embossments. A third portion 812 is principally aft of the second portion 808 and meets it at a fold line 814 in large part defined by a single embossment. Internally, the third portion includes a circular aperture 816. A pair of elongate rectangular transversely-extending apertures or cutouts 818 are provided proximate the fold line 814 (e.g., exactly aft of the fold line) and are of complementary dimensions and positions to the tabs 806 as described below.

A fourth portion 820 is principally aft of the third portion 812 and meets it at a fold line 822 in large part defined by a single embossment. An elongate rectangular transversely-extending aperture or cutout 824 is provided proximate the fold line 822 (e.g., exactly forward of the fold line). Internally, the fourth portion includes a folding portion 826 (the folding operation being discussed below) separated from the remainder of the fourth portion by a convoluted branching cut line 828 extending in an open loop to/from the fold line 822. A transverse fold line 830 internal to the folding portion 826 in major part separates first and second subportions 832 and 834. The first subportion 832 includes at its aft end a pair of left and right tabs 835.

A fifth portion 836 is principally aft of the fourth portion and meets it in part at a fold line 838 formed by a pair of closely-spaced parallel embossments. Centrally, the fourth and fifth portions meet along a cut line 840 defining a projection 842 of the fifth portion forward within the second portion The projection includes a pair of circular transversely spaced apertures 844. The fifth portion also includes an elongate rectangular transversely-extending aperture or cutout 846 in a central location. At its aft end, the fifth portion has a tab 848. In the exemplary embodiment, an additional portion 850, which is also an aftmost portion, is principally aft of the fifth portion and meets it along a fold line 852 extending transversely on opposite sides of the root of the tab 848. At its aft end (which is the aft end of the exemplary blank), the additional portion includes a tab 854. Fore and aft fold lines 856 and 857 are located internal to the additional portion and divide the additional portion into three subportions of which the central subportion is the largest and the outboard subportions are of approximately equal extent.

For forming the sides of the tray, the blank includes a pair of left and right sixth portions 860 on either side of the third portion 812 and meeting it at least in part at fold lines 862. A pair of left and right seventh portions 864 extend forward from the associated sixth portions and alongside at least part of the second portion. The seventh portions meet the associated sixth portions at least in part at associated fold lines 866 which, in the exemplary embodiment, are continuous with the fold line 814 with the blank flat. The seventh portions are separated from adjacent sides of the second portion by cut lines 868. A pair of left and right eighth portions 870 similarly extend aft from the fifth portions meeting them at least in part along fold lines 872 and separated from the fourth portion by cut lines 874. The exemplary eighth portions include an elongate rectangular longitudinally-extending aperture or cutout 876 in their interiors and an elongate rectangular longitudinally extending notch 878 extending forward from their aft ends.

To perform a basic assembly operation, the blank is folded along the fold lines 862 so that the sixth portions at least partially define the left and right side walls and the third portion at least partially defines a bottom wall. The blank is then folded along the fold lines 866, 814, and 810 to sandwich the tab-like portion 864 between the portions 806 and 808, with the tabs 806 being received and captured by the cutouts 818 for retention. In similar fashion, the blank is folded along the fold lines 872, 822 and 838 to sandwich the portions 870 between the portions 820 and 836 so that the portions 820, 836 and 870 at least partially define the back wall, with the portion 820 principally defining a rear layer of the back wall and the portion 836 at least partially defining a front layer. This operation causes the tab 848 to be received by the cutout 824. Additionally, the operation produces an alignment of the cutouts 876 with the folding portion 826 and an alignment of the notches 878 with associated halves of the cutout 846.

Figure 58:
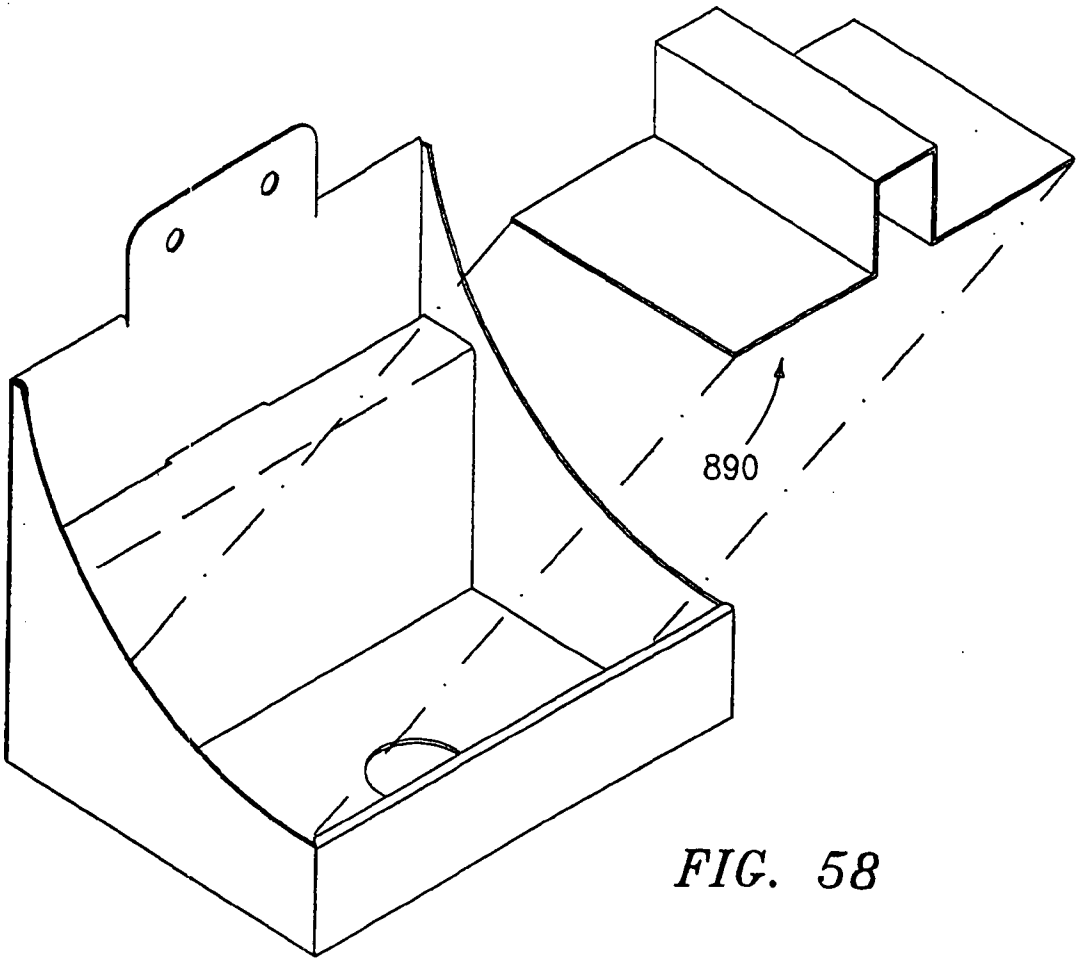
FIGS. 58 and 59 are side and perspective views of a tray formed by the blank of FIG. 57.

At this point, there are a number of options for configuring the exemplary tray into a variety of conditions. A first feature involves the deployment of the additional or ninth portion 850. In a stowed first condition, the entire ninth portion is folded along the fold line 852 and extends flat along and atop the third portion 812 to provide an additional layer of the bottom wall. In this condition, the tab 854 extends between a notch 882 in the fore end of the first portion 804 and the upper surface of the portion 812. For this purpose, the notch 882 between the tabs 886 of the front wall may be recessed slightly aft of portions of the fore end of the first portion 804 outboard of those tabs. In a deployed second condition, the ninth portion 850 may be folded back ninety degrees at its fold line 856 and a further ninety degrees at its fold line 857 so that the tab 854 may extend into and be captured by the aperture 846 and, optionally, one or both of the coaligned apertures 876. In this condition, the central portion of the ninth portion 850 provides a forwardly offset lower portion of the back wall of the tray (FIG. 58). This may allow the tray to more closely accommodate its contents or may allow greater ease of a user grasping those contents by allowing the user's fingers to more easily get between the contents and the back wall. The aperture 816 in the third portion 812 permits a user to insert a finger or other tool from below and disengage the ninth wall 850 from its stowed condition to either allow disassembly of the tray or redeployment of the ninth portion to its deployed condition. An alternative location of the fold lines of the ninth portion could create a ledge for elevating product in the rear half (or other fraction) of the tray. FIG. 58 also shows a removable folded corrugated divider 890 dimensioned so that when folded along four fold lines it fits within the tray ahead of the lower portion of the back wall. The divider separates the tray compartment and can help accommodate situations wherein the total width of two rows of articles is somewhat less than the width of the tray. A central portion of the divider defines a top of a longitudinal wall with portions immediately therebeyond defining left and right sides of that wall and outboardmost portions extending along the upper surface of the tray bottom wall.

Figure 59:
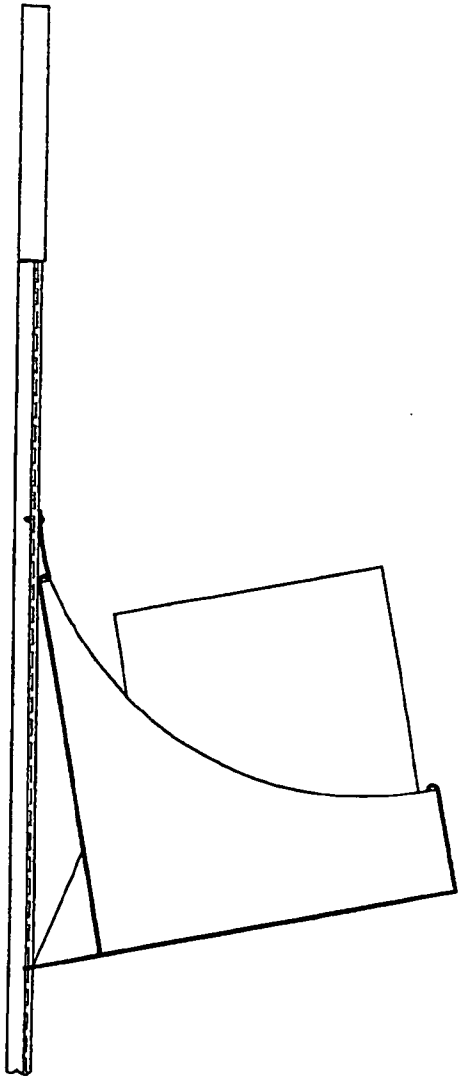

A second feature involves deployment of the folding portion 826. In a stowed first condition, the folding portion remains continuous and coplanar with the remainder of the fourth portion 820. In a deployed second condition, however, the folding portion is folded along its line 830, disengaging itself from the remainder of the fourth portion along the cut line 828. The lower portion or subportion 834 extends at least partially rearward (rearward and upward in the example) from a root proximate the rear end of the bottom wall to the fold line 830. The upper portion or subportion 832 then extends back from the fold line 830 to meet the remainder of the fourth portion 820. In the exemplary embodiment, the apertures 876 in the eighth portion 870 are exposed through the opening defined by the cutline 828 due to the deployment of the folding portion 826. The apertures 876 have complementary positions and dimensions to the tabs 835 so as to receive those tabs with the folding portion deployed. For further structural integrity of the deployed folding portion, at the outboard ends of the tabs 835, the upper portion 832 includes a pair of shoulders 884. The cut line also defines a pair of shoulders 886 at a location which in the blank defines the aft outboard ends of the second portion 834. With the folding portion deployed, the shoulders 884 may bear against the shoulders 886 to further retain the folding portion in the deployed condition. The folding portion may be disengaged by pulling downward to extract the tabs 835 from the apertures 876 and optionally returned to a stowed condition if desired. In the deployed condition, the folding portion extends rearward out of the plane of the remainder of the fourth portion. FIG. 59 shows that, with the tray attached to a vertical support surface (such as a strut) at a location relatively high on the back wall of the tray, the engagement of the folding portion (e.g., along its fold line) with the support surface tilts the tray so as to cause a front to back declination of the tray. This may help prevent articles from falling forward out of the tray.

Preferably, if such trays are preassembled to a strut and shipped in a carton, they are preassembled with their folding portions stowed. When a user removes the assembly from the carton, the user may then deploy the folding portions to tilt the trays relative to the strut.

One or more embodiments of the present invention have been described. Nevertheless, it will be understood that various modifications may be made without departing from the spirit and scope of the invention. For example, various manufacturing techniques may be utilized and the system may be modified to suit particular needs. The molded or extruded kit parts may be formed in a variety of colors or in transparent or translucent forms. Advantageously, for economy certain portions may be formed only in a given color. For example, pieces not visible to the user could all be formed in light. Accordingly, other embodiments are within the scope of the following claims.

What is claimed is:

1. A retail display apparatus, comprising:

a chassis comprising;

a generally rectangular central portion of a folded box construction formed in major part of material selected from the group consisting of boxboard and corrugated plastic and fibrous materials; and at least left and right plastic frame members secured along left and right side edges of the central portion;

a base supporting the chassis above a ground surface; and a plurality of shelf assemblies having pairs of left and right engagement members for removable securement to left and right engagement features of the chassis;

wherein:

the base comprises a folded multi wall corrugated structure;

the chassis engagement features comprise left and right vertical arrays of apertures in a front of the central portion; and at least one of the shelf assemblies comprises:

a corrugated tray; and left and right molded plastic brackets respectively comprising the left and right engagement members of the shelf assembly.

2. The apparatus of claim 1 further comprising a hinged header member secured to the chassis, the header hingeable between a deployed condition wherein a first surface of the header extends upward from the chassis member, substantially coplanar with the front face, and a stowed condition located substantially behind the chassis.

3. The apparatus of claim 1 further comprising a pair of left and right generally quadrilateral trim panels held by associated forwardly open channels in the left and right frame members, respectively.

4. The apparatus of claim 1, further comprising:

a tab upwardly extending from each bracket, the tab being received in a slot disposed in the associated bottom edge of the associated tray.

5. The apparatus of claim 1, wherein each chassis engagement feature comprises a tab disposed proximate a corresponding one of the vertical arrays of apertures, the tab contacts a portion of the engagement member to retain the engagement member within the aperture.

6. The retail apparatus of claim 5, wherein the tab is defined by cut lines formed in the chassis, the cut lines extending from the aperture.

7. The apparatus of claim 1, wherein the left plastic frame member is disposed between the central portion and a portion of each of the left engagement members of the plurality of shelf assemblies, and the right plastic frame member is disposed between the central portion and a portion of each of the right engagement members of the plurality of shelf assemblies.

* * * * *